US010808516B2

(12) United States Patent
Brown et al.

(10) Patent No.: US 10,808,516 B2
(45) Date of Patent: Oct. 20, 2020

(54) CROSSOVER SYSTEM AND APPARATUS FOR AN ELECTRIC SUBMERSIBLE GAS SEPARATOR

(71) Applicant: Halliburton Energy Services, Inc., Houston, TX (US)

(72) Inventors: Donn J. Brown, Broken Arrow, OK (US); Wesley John Nowitzki, Tulsa, OK (US); Joshua Wayne Webster, Sand Springs, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/726,719

(22) Filed: Dec. 24, 2019

(65) Prior Publication Data

US 2020/0141223 A1 May 7, 2020

Related U.S. Application Data

(63) Continuation-in-part of application No. 16/335,223, filed as application No. PCT/US2018/045810 on Aug. 8, 2018.

(60) Provisional application No. 62/551,850, filed on Aug. 30, 2017.

(51) Int. Cl.
*E21B 43/38* (2006.01)
*E21B 43/12* (2006.01)

(52) U.S. Cl.
CPC ..... *E21B 43/38* (2013.01); *E21B 43/121* (2013.01); *E21B 43/128* (2013.01)

(58) Field of Classification Search
CPC ..... E21B 43/121; E21B 43/38; E21B 43/128
See application file for complete search history.

(56) References Cited

U.S. PATENT DOCUMENTS

| | | | | |
|---|---|---|---|---|
| 7,377,313 | B2 * | 5/2008 | Brown | F04D 13/10 166/105.5 |
| 7,461,692 | B1 | 12/2008 | Wang | |
| 8,747,078 | B2 | 6/2014 | Brown et al. | |
| 2005/0281683 | A1 | 12/2005 | Brown et al. | |
| 2006/0245945 | A1 | 11/2006 | Wilson et al. | |

(Continued)

FOREIGN PATENT DOCUMENTS

| | | | |
|---|---|---|---|
| WO | 2015020798 | A1 | 2/2015 |
| WO | 2019045979 | A1 | 3/2019 |

OTHER PUBLICATIONS

Foreign Communication from Priority Application—International Search Report and Written Opinion of the International Searching Authority, International Application PCT/US2018/045810, dated Dec. 4, 2018, 9 pages.

(Continued)

*Primary Examiner* — Tara Schimpf
(74) *Attorney, Agent, or Firm* — Conley Rose, P.C.; Rodney B. Carroll

(57) ABSTRACT

A crossover of an electric submersible pump (ESP) gas separator. The crossover comprises a skirt defining a plurality of exits, passageways, and entrances, each exit associated with one of the passageways and one of the entrances, wherein each entrance is proximate to an inner chamber of the gas separator and a jacket circumferentially surrounding the skirt and defining a plurality of exits, wherein the rotational position of the jacket relative to the skirt is adjustable.

17 Claims, 20 Drawing Sheets

(56) References Cited

U.S. PATENT DOCUMENTS

| | | | | |
|---|---|---|---|---|
| 2009/0272538 | A1* | 11/2009 | Kennedy | E21B 43/38 166/369 |
| 2011/0162832 | A1 | 7/2011 | Reid | |
| 2014/0216720 | A1 | 8/2014 | Wang et al. | |
| 2019/0249537 | A1 | 8/2019 | Brown et al. | |

OTHER PUBLICATIONS

Foreign Communication from Priority Application—International Preliminary Report on Patentability, International Application No. PCT/US2018/045810, dated Mar. 3, 2020, 7 pages.
Office Action dated Mar. 19, 2020 (7 pages), of priority U.S. Appl. No. 16/335,223, filed Mar. 20, 2019.
Final Office Action dated Jun. 11, 2020 (6 pages), of priority U.S. Appl. No. 16/335,223, filed Mar. 20, 2019.
Notice of Allowance and Fees Due dated Aug. 7, 2020 (10 pages), from U.S. Appl. No. 16/335,223, filed Mar. 20, 2019.

* cited by examiner

CROSSOVER SYSTEM AND APPARATUS FOR AN ELECTRIC SUBMERSIBLE GAS SEPARATOR

CROSS-REFERENCE TO RELATED APPLICATIONS

The present application is a continuation-in-part of U.S. patent application Ser. No. 16/335,223 filed Mar. 20, 2019, published as U.S. Patent Application No. US 2019/0249537A1, which is a filing under 35 U.S.C. 371 of International Application No. PCT/US2018/045810 filed Aug. 8, 2018, both of which entitled "Crossover System and Apparatus for an Electric Submersible Gas Separator," which claims priority to U.S. Provisional Patent Application No. 62/551,850, filed on Aug. 30, 2017, each of which is incorporated herein by reference as if reproduced in its entirety.

BACKGROUND

Embodiments described herein pertain to the field of gas separators for electric submersible pumps. More particularly, but not by way of limitation, one or more embodiments enable a crossover system, method and apparatus for an electric submersible gas separator. Fluid, such as gas, oil or water, is often located in underground formations. In such situations, the fluid must be pumped to the surface so that it can be collected, separated, refined, distributed and/or sold. Centrifugal pumps are typically used in electric submersible pump (ESP) applications for lifting well fluid to the surface. Centrifugal pumps impart energy to a fluid by accelerating the fluid through a rotating impeller paired with a stationary diffuser, together referred to as a "stage." Multistage centrifugal pumps use several stages of impeller and diffuser pairs to further increase the pressure lift.

One challenge to economic and efficient ESP operation is pumping gas laden fluid. When pumping gas laden fluid, the gas may separate from the other fluid due to the pressure differential created when the pump is in operation. If there is a sufficiently high gas volume fraction (GVF), typically around 10% to 15%, the pump may experience a decrease in efficiency and decrease in capacity or head (slipping). If gas continues to accumulate on the suction side of the impeller it may entirely block the passage of other fluid through the centrifugal pump. When this occurs the pump is said to be "gas locked" since proper operation of the pump is impeded by the accumulation of gas.

Conventional ESPs often include a gas separator attached below the centrifugal pump in an attempt to separate gas out of the multi-phase fluid before the gas reaches the pump. The two most common types of gas separator are vortex type and rotary type separators. Both vortex and rotary type separators separate gas from the well fluid by inertia of rotation before fluid enters the pump. Such centrifugal separation forces higher density, gas poor fluid outward, while lower density, gas rich fluid remains inward near the shaft. Next, the fluid travels to a crossover, which partitions the two fluid streams. The lower density, gas rich fluid vents into the casing annulus between the ESP assembly and the well casing, while the higher density, gas poor fluid is guided to the centrifugal pump.

Because gas separators use the inertia of rotational motion to separate fluid, fluid entering the crossover is spinning. Since the crossover directs gas rich fluid and gas poor fluid in different directions, the spinning fluid abruptly changes direction inside the conventional crossover. The abrupt changes in direction result in disruptive turbulence that degrades the efficiency of the gas separator. The turbulence impedes the flow of fluid, causing gas to accumulate and coalesce into bubbles inside the conventional crossover. The gas bubbles can become entrapped in fluid traveling into the pump, leading to gas lock. Additionally, the lower density, gas rich fluid being directed towards the casing annulus readily loses momentum often preventing the gas from ever reaching the casing annulus.

Conventionally, the trajectory of higher density, gas poor fluid flowing towards the centrifugal pump also includes sharp turns as the higher density fluid circumnavigates around the vent ports of the lower density fluid. The induced turbulence causes collisions between the higher density fluid and the walls of the crossover passageway. Because the higher density fluid is often laden with abrasive solids, the result is internal pressure changes, erosive damage and scale blocking inside the conventional crossover.

Yet another problem with conventional crossovers, is that higher density fluid exiting the crossover retains leftover rotational momentum, sometimes called "pre-rotation." Pre-rotation of fluid at the pump entrance will limit the pump impeller vanes from cutting through the production fluid and delivering the fluid downstream. As a result, pre-rotation of the well fluid will degrade the pump's efficiency and overall performance, which can limit the production rate of the ESP assembly.

As is apparent from the above, conventional crossovers employed in gas separators suffer from several deficiencies. Therefore, there is need for an improved crossover apparatus, method and system for an electric submersible gas separator.

BRIEF DESCRIPTION OF THE DRAWINGS

Advantages of the present disclosure may become apparent to those skilled in the art with the benefit of the following detailed description and upon reference to the accompanying drawings in which.

Figure 1:
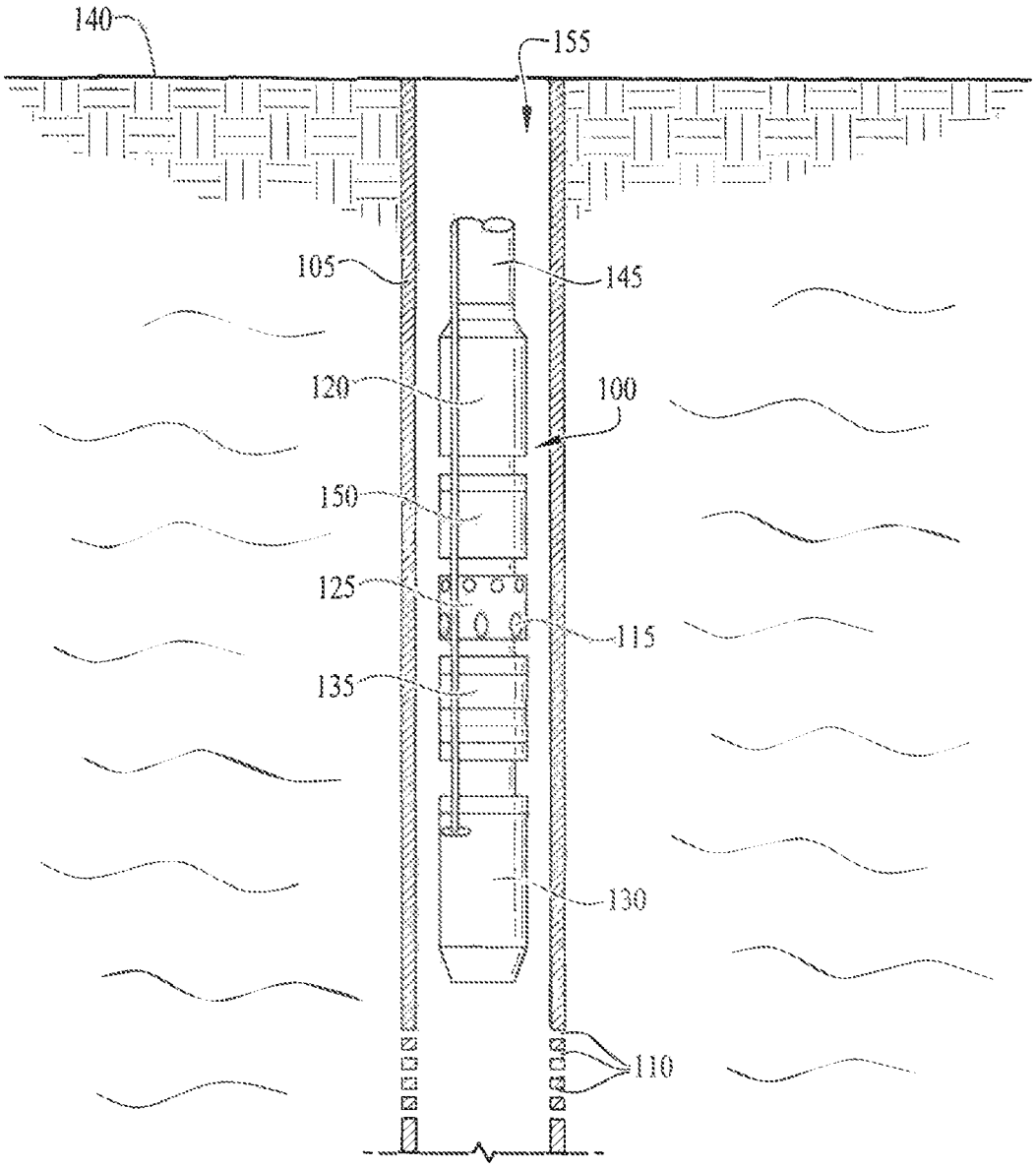
FIG. 1 is a perspective view of an electric submersible pump (ESP) assembly of an illustrative embodiment.

While the teaching of the present disclosure is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the disclosure to the particular form disclosed, but on the contrary, the intention is to cover all modifications, equivalents and alternatives falling within the scope of the present disclosure as defined by the appended claims.

DETAILED DESCRIPTION

A crossover system, method and apparatus for an electric submersible gas separator is described. In the following exemplary description, numerous specific details are set forth in order to provide a more thorough understanding of embodiments of the disclosure. It will be apparent, however, to an artisan of ordinary skill that the present disclosure may be practiced without incorporating all aspects of the specific details described herein. For example, advantages and benefits can be attained from using an adjustable jacket and skirt of a gas separator to define a size of exit port of the gas separator as described herein without at the same time adopting the teardrop shaped crossover channels or exits described herein. In other instances, specific features, quantities, or measurements well known to those of ordinary skill in the art have not been described in detail so as not to obscure the disclosure. Readers should note that although examples are set forth herein, the claims, and the full scope of any equivalents, are what define the metes and bounds of the disclosed teachings.

As used in this specification and the appended claims, the singular forms "a", "an" and "the" include plural referents unless the context clearly dictates otherwise. Thus, for example, reference to an "opening" includes one or more openings.

"Coupled" refers to either a direct connection or an indirect connection (e.g., at least one intervening connection) between one or more objects or components. The phrase "directly attached" means a direct connection between objects or components.

As used herein, the term "outer," "outside" or "outward" means the radial direction away from the center of the shaft of an ESP assembly element such as a gas separator and/or the opening of a component through which the shaft would extend.

As used herein, the term "inner", "inside" or "inward" means the radial direction toward the center of the shaft of an ESP assembly element such as a gas separator and/or the opening of a component through which the shaft would extend.

As used herein the terms "axial", "axially", "longitudinal" and "longitudinally" refer interchangeably to the direction extending along the length of the shaft of an ESP assembly component such as an ESP intake, multi-stage centrifugal pump, seal section, gas separator or charge pump.

"Downstream" refers to the direction substantially with the principal flow of working fluid when the pump assembly is in operation. By way of example but not limitation, in a vertical downhole ESP assembly, the downstream direction may be towards the surface of the well. The "top" of an element refers to the downstream-most side of the element.

"Upstream" refers to the direction substantially opposite the principal flow of working fluid when the pump assembly is in operation. By way of example but not limitation, in a vertical downhole ESP assembly, the upstream direction may be opposite the surface of the well. The "bottom" of an element refers to the upstream-most side of the element.

"Teardrop" refers to a shape having a wider, rounded side or end opposite a tapered and/or pointed side or end.

For ease of description and so as not to obscure the disclosure, illustrative embodiments are primarily described with reference to a motor operating at or about 60 Hz, which theoretically corresponds to a drive shaft rotation of about 3600 revolutions-per-minute (RPM). Illustrative embodiments may therefore include geometry that is based on about 3550 RPM of energy imparted on the well fluid during operation, which accounts for slip and other energy losses in the rotating fluid that slow rotation. However, illustrative embodiments are not so limited and may be equally applied to ESPs operating anywhere from 30 Hz to 70 Hz. and the resulting rotational speed of the drive shaft and/or fluid.

Illustrative embodiments may reduce turbulence in fluid flowing through the crossover of a gas separator by improving the geometry of the crossover's passageways. One or more of the improvements of illustrative embodiments may increase the efficiency of the crossover as well as the gas separator's overall performance, thus improving centrifugal pump efficiency. Illustrative embodiments may guide lower density, gas rich fluid toward the casing annulus for ventilation with improved momentum and a reduced likelihood of gas reentrapment and the resulting gas lock. Illustrative embodiments may deliver higher density, gas poor fluid to a centrifugal pump with reduced pre-rotation, which may improve the pump's efficiency and overall performance. Illustrative embodiments may reduce scale blocking, erosion, and abrasive damage resulting from higher density, gas poor fluid carrying sand into the gas separator.

Illustrative embodiments may provide: (1) a specific angle or trajectory for higher density, gas poor fluid flowing through the crossover of illustrative embodiments, creating less resistance and turbulence in the stream, (2) tangential communicated exit ports in the flow path of the lower density, gas rich fluid chamber of the crossover, which may also provide for lower resistance and turbulence, and (3) a spider bearing support within the crossover designed to inject a non-rotation component to the higher density, gas poor fluid exiting the crossover, which may increase the downstream pump's efficiency.

Illustrative embodiments may include a plurality of teardrop shaped channels, which channels define a first helical passageway inside each channel for lower density, gas rich fluid and a second helical passageway around the outside of each channel for higher density, gas poor fluid. The first and second helical passageways may guide the corresponding fluid streams into and out of the passageways with a tangential component that provides gentle entrance and exit angles for the fluid, which may reduce turbulence, gas reentrapment, erosion and/or abrasive wear. The top, upper surface of the channel may serve as a support wall for the higher density, gas poor fluid, which support wall may be tilted to guide the gas poor fluid gently upward at a 10-40° angle from a horizontal plane, as compared to steeper angles of conventional crossovers that are typically 450. An entrance of the first helical passageway inside the channel, formed at the intersection between each channel and the crossover skirt, may extend along a concave top section of the skirt and may be 10-70% larger in surface area than conventional openings in comparable conventional crossover designs, which entrances may guide gas rich fluid with a gentle entrance angle into the first helical passageway. A first helical passageway exit may be formed at a tangential intersection between each channel and the crossover jacket, which tangential intersection may allow the passageway exit to guide gas rich fluid out of the first helical passageway with a gentle exit angle. Illustrative embodiments may include a modified spider bearing fluidly coupled to the higher density, gas poor fluid exiting the second helical passageways. The spider bearing of illustrative embodiments may include crescent shaped vanes having a concave surface that receives incoming fluid and remove rotational momentum of the gas poor fluid by ramping the fluid upward in an increasingly axial direction. The spider bearing vanes may provide axial momentum to the higher density, gas poor fluid, which may prevent pre-rotation in a downstream centrifugal pump. The spider bearing of illustrative embodiments may provide radial support to the drive shaft, which may prevent operation-limiting damage to the ESP assembly.

Illustrative embodiments may comprise a crossover having a skirt having a first plurality of exits coupled to a gas exit channel of a gas separator and a jacket surrounding the skirt, where the jacket has exits. The jacket is concentric with the skirt and is configured to be rotated about the skirt so as to adjust the size of the opening of the exits. This adjustable jacket and skirt combination can be advantageously used in a variety of gas separator embodiments, and is not limited to use in combination with teardrop shaped crossover channels also disclosed herein.

Illustrative embodiments may include an artificial lift assembly, such as an ESP assembly, which may be located downhole below the surface of the ground. FIG. 1 shows an exemplary ESP assembly 100. ESP assembly 100 may be positioned within well casing 105, which may separate ESP assembly 100 from an underground formation. Well fluid may enter casing 105 through perforations 110 and travel downstream inside casing annulus 155 to intake ports 115. Intake ports 115 may serve as the intake for ESP pump 120 and may be located on an ESP intake section or may be integral to gas separator 125. Gas separator 125 may be a vortex or rotary separator and may serve to separate gas from the well fluid before it enters ESP pump 120. Motor 130 may be an electric submersible motor that operates to turn ESP pump 120 and may, for example, be a two-pole, three-phase squirrel cage induction motor. Seal section 135 may be a motor protector, serving to equalize pressure and keep motor oil separate from well fluid. ESP Pump 120 may be a multi-stage centrifugal pump and may lift fluid to surface 140. Production tubing 145 may carry pumped fluid to surface 140, and then into a pipeline, storage tank, transportation vehicle and/or other storage, distribution or transportation means. In gassy wells, charge pump 150 may be employed between primary pump 120 and gas separator 125 as a lower tandem pump to boost fluid before it enters production pump 120.

Figure 2:
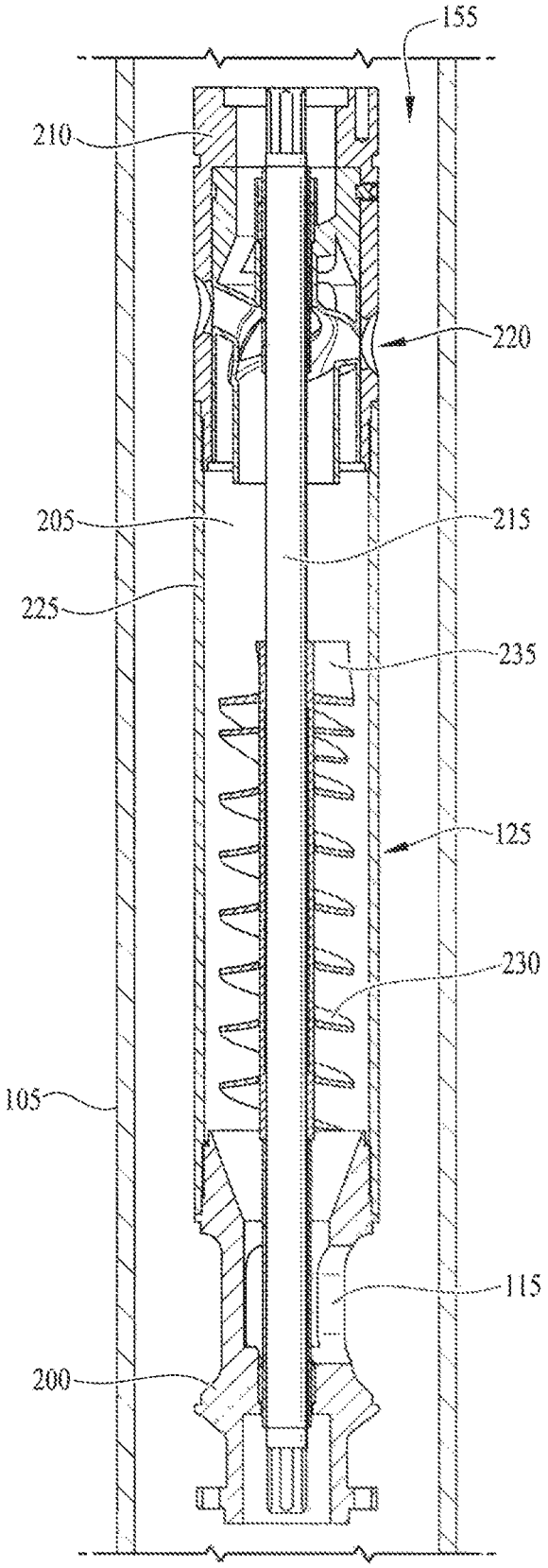
FIG. 2 is a cross-sectional view of a gas separator of an illustrative embodiment.

FIG. 2 shows an exemplary gas separator of an illustrative embodiment. Gas separator 125 may include from upstream to downstream, intake section 200, separation chamber 205, and crossover 210. Inlet ports 115 may be spaced circumferentially around intake section 200 and serve as the intake for fluid into ESP assembly 100. Multi-phase well fluid may enter inlet ports 115 from casing annulus 155 and travel downstream through separation chamber 205. While inside separation chamber 205, well fluid may be separated by inertia of rotation into higher-density, gas poor fluid and lower-density, gas rich fluid. Housing 225 may separate separation chamber 205 and/or gas separator 125 from casing annulus 155 and may serve as a supportive structure that transmits axial loads across gas separator 125. Housing ports 220 may be spaced around housing 225 and may allow the lower density, gas rich fluid to exit gas separator 125 and vent into casing annulus 155. Shaft 215 may be rotated by ESP motor 130 (via the intervening shaft of seal section 135) and extend longitudinally and centrally through gas separator 125.

Auger 230 may be keyed to gas separator shaft 215 and may impart axial momentum to multi-phase well fluid travelling through separation chamber 205. Auger 230 may be a high-angle vane auger or similar fluid moving element. In some embodiments, an impeller and/or stage may be used in place of auger 230. In vortex-type gas separators 125, one or more vortex generators 235 may be included downstream of auger 230. Vortex generator 235 may be keyed to shaft 215 and may rotate with shaft 215. Generator 235 may impart multi-phase well fluid with a vortex-shaped trajectory through separation chamber 205, which may separate the multi-phase fluid into the respective higher density, gas poor fluid 305 and lower density, gas rich fluid 300 by inertia of rotation. In some embodiments, gas separator 125 may be a rotary type separator and may include a rotary rather than vortex generator 235.

Figure 3A:
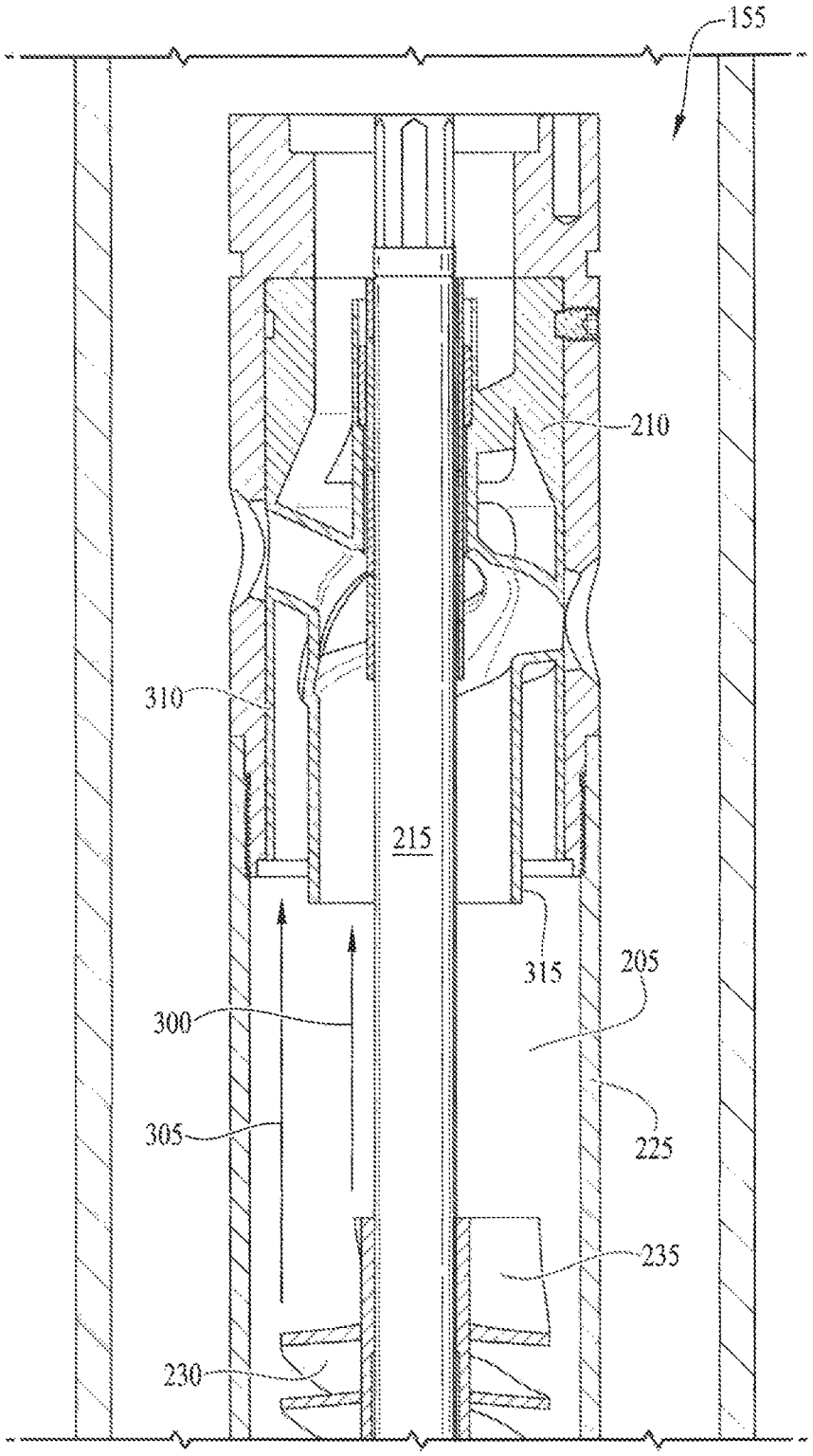
FIGS. 3A-3B are cross-sectional views of a separation chamber and crossover of an illustrative embodiment.
Figure 3B:
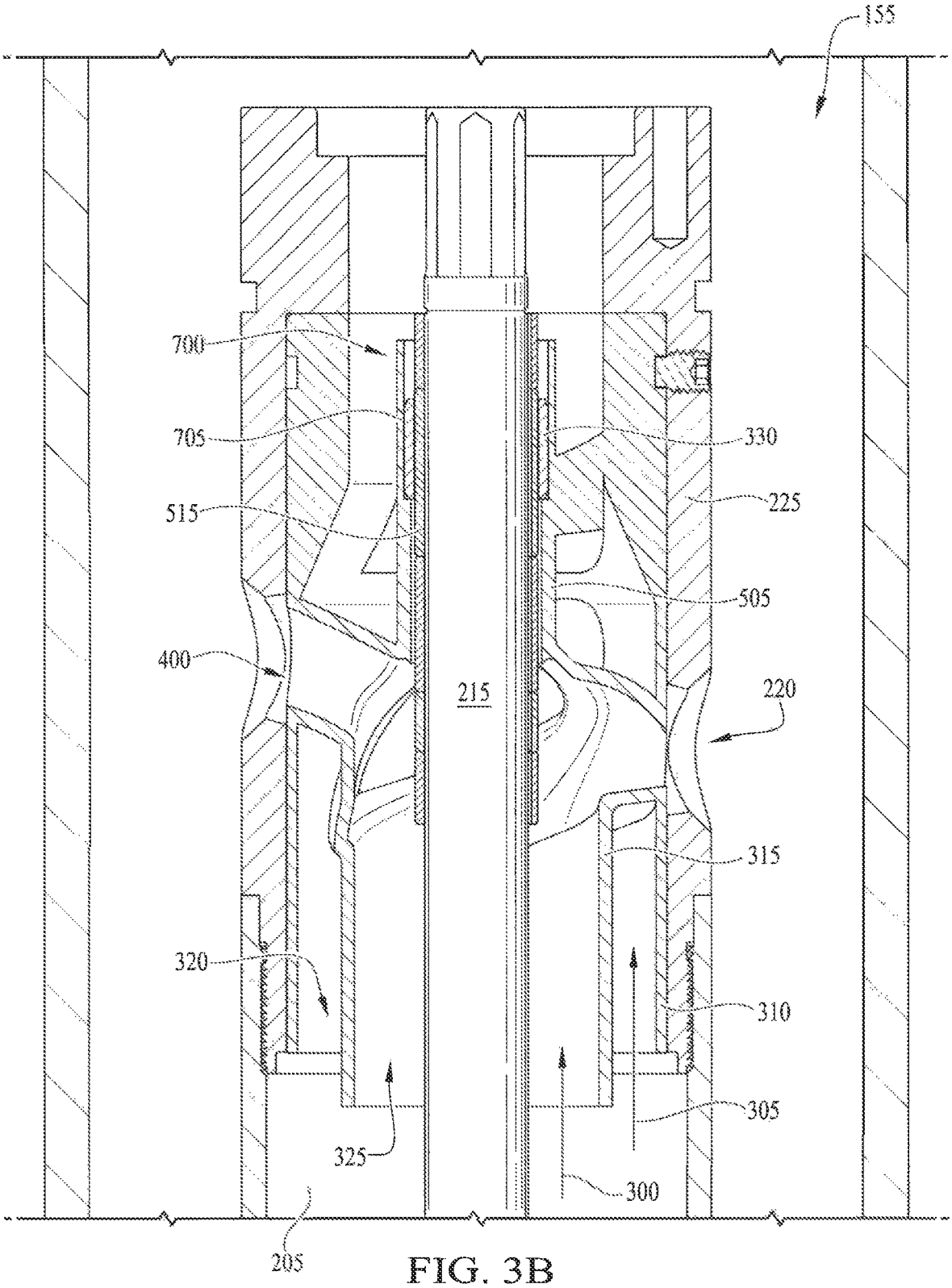

From separation chamber 205, the multi-phase fluid may proceed to crossover 210, where lower density, gas rich fluid 300 may be vented into casing annulus 155, while higher density, gas poor fluid 305 may continue to pump 120. As shown in FIGS. 3A-3B, due to rotational inertia, lower density, gas rich fluid stream 300 may gravitate close to shaft 215, flowing inside skirt 315 of crossover 210. Higher density, gas poor fluid 305 may gravitate outwards and travel into the space between jacket 310 and skirt 315.

For illustration purposes in FIGS. 3A-3B, fluid streams 300, 305 are shown flowing in a straight downstream direction, however, as a result of vortex generator 235 or a rotary, both streams are also rotating while flowing downstream and, as a result, may adopt a helical, screw-shaped, and/or spiral-shaped trajectory through crossover 210. Such a helical trajectory may be composed of an axial downstream component combined with a rotational component about a central longitudinal axis and/or shaft 215. The rotational component can follow a clockwise or a counterclockwise direction, depending on the rotational direction of shaft 215. Examples of helically-directed flow trajectories for higher density, gas poor fluid 305 and lower density, gas rich fluid stream 300 are illustrated in FIGS. 6A-6G. In this example, the rotational component of both helical fluid streams 300, 305 may be directed in a counterclockwise direction, for example following counterclockwise rotational direction 615 in FIG. 6A. Additionally, the rotational speed of fluid streams 300, 305 may be determined by the rotational speed of shaft 215 and/or ESP motor 130. Fluid streams 300, 305 in FIGS. 6A-6D may be rotating at or about 3550 RPM, resulting from ESP assembly 100's operation at 60 Hz. However, illustrative embodiments may be equally applied to an ESP assembly operating anywhere from 30 Hz to 70 Hz and driving the rotation of well fluid at higher or lower rotational speeds than 3550 RPM.

Figure 6A:
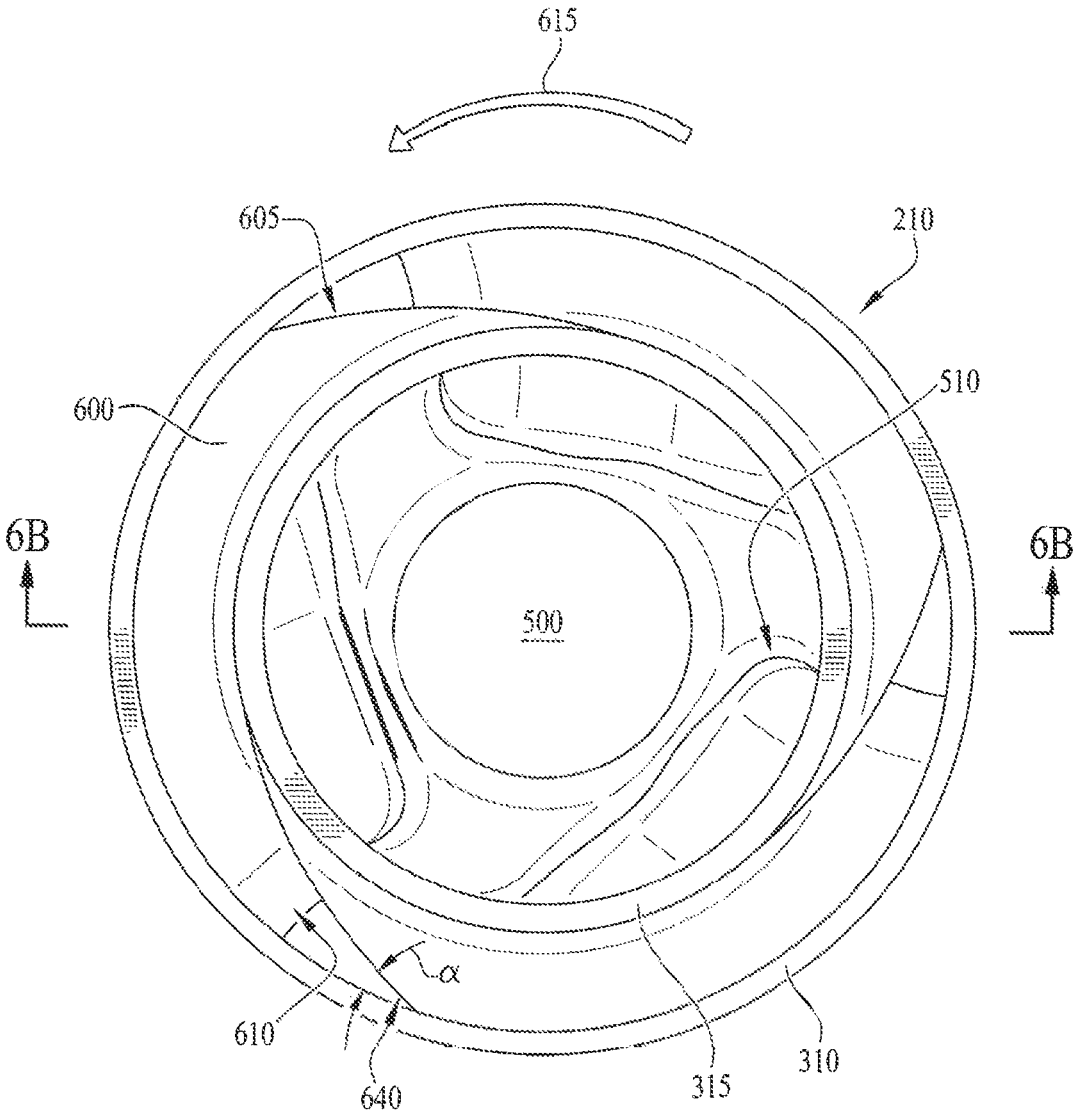
FIG. 6A is a bottom plan view of an exemplary crossover of an illustrative embodiment.
Figure 6B:
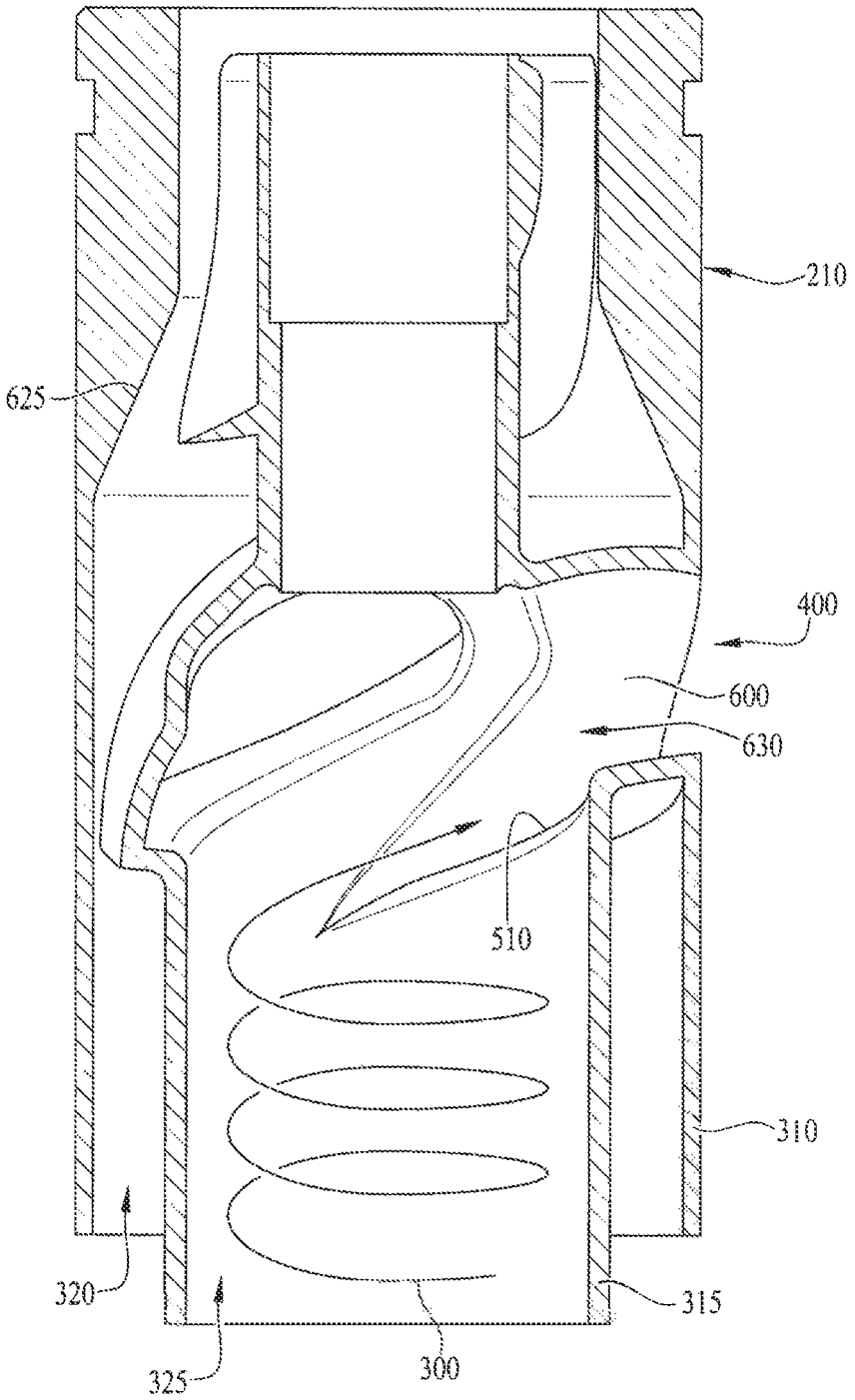
FIG. 6B is a cross-sectional view of an exemplary crossover of an illustrative embodiment.
Figure 6C:
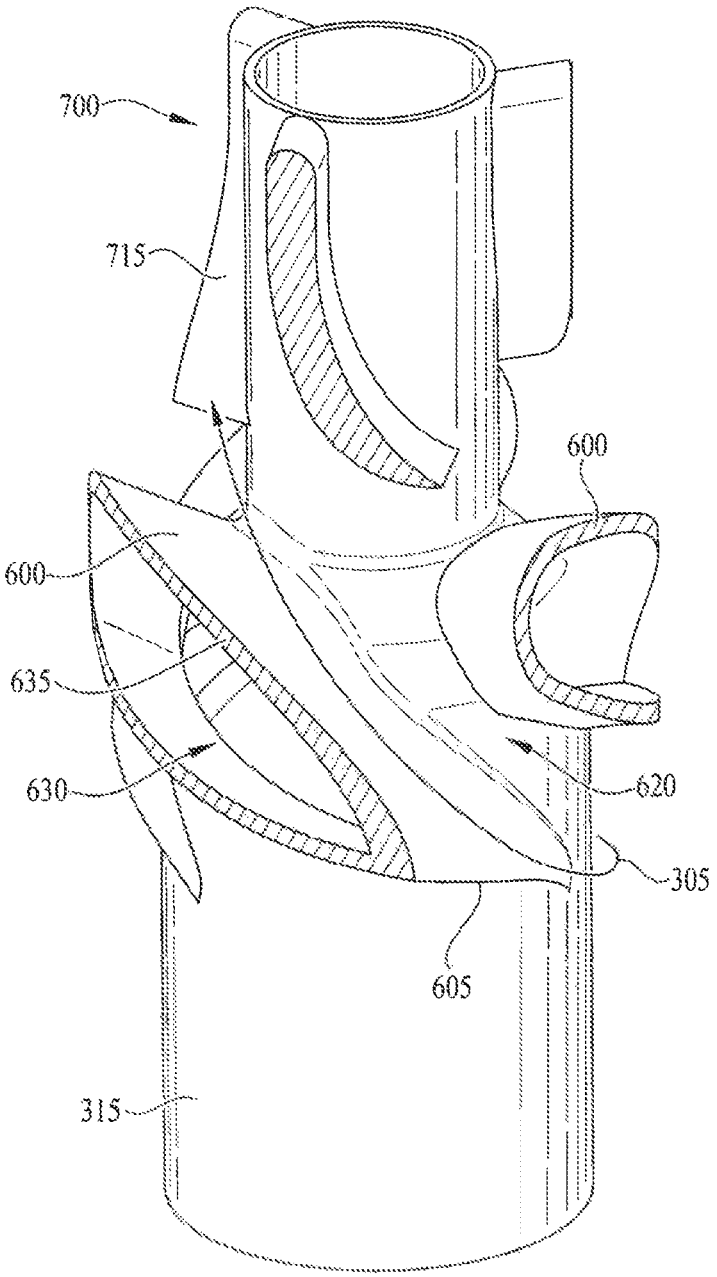
FIG. 6C is a perspective view of an exemplary skirt of an illustrative embodiment.
Figure 6D:
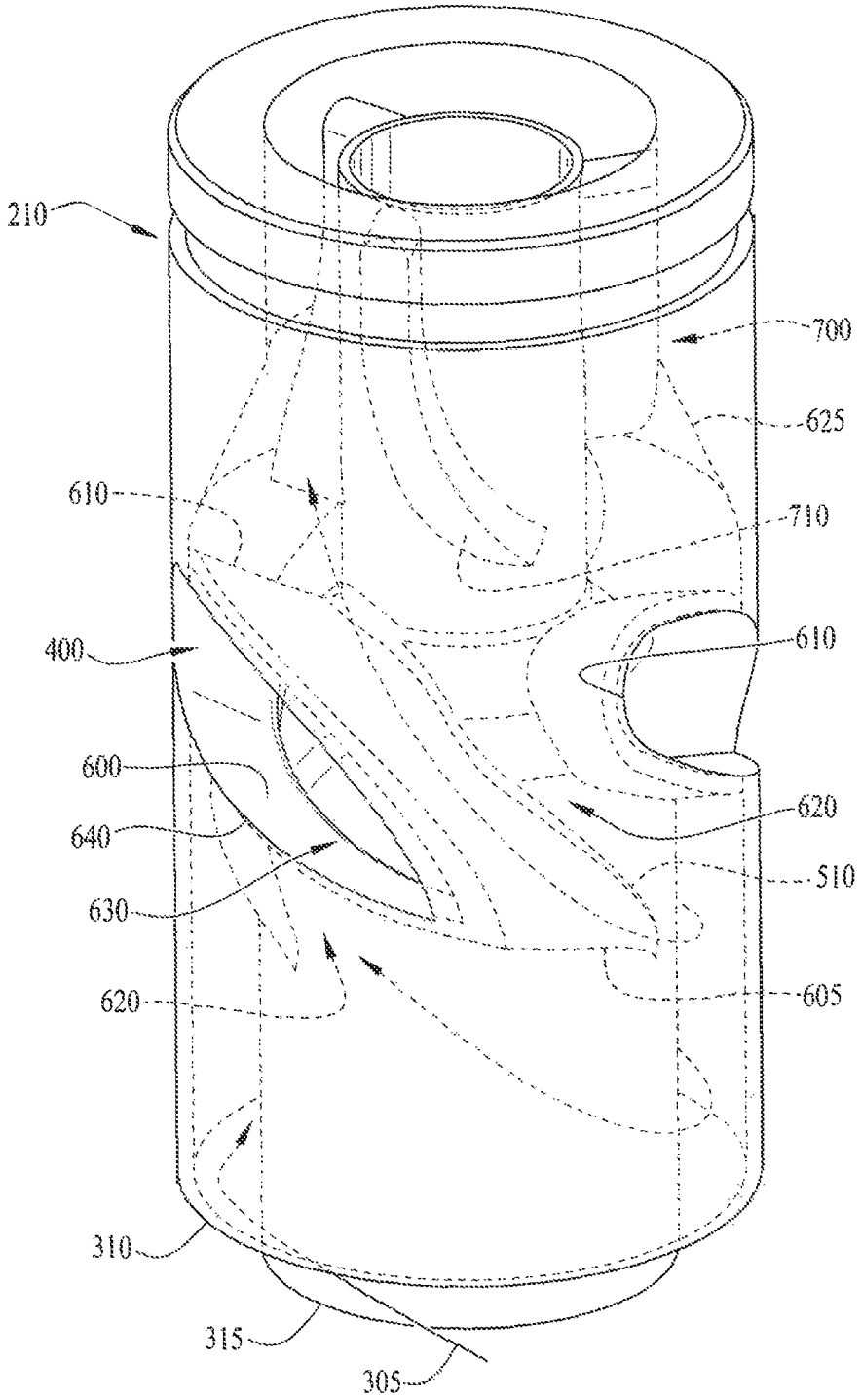
FIG. 6D is a perspective view of an exemplary crossover of an illustrative embodiment.

Turning to FIGS. 6C-6D, the crossover 210 of illustrative embodiments may include a plurality of teardrop shaped channels 600 oriented to follow the helical flow trajectories of fluid streams 300, 305 to beneficially reduce and/or prevent efficiency-reducing turbulence and/or gas accumulation. A first helical passageway 630 may extend through the inside of each channel 600 and may guide lower density, gas rich fluid 300 from inside skirt 315 to flow through channel 600 and vent into casing annulus 155. A second helical passageway 620 may be formed around the outside of each channel 600, through which higher density, gas poor fluid 305 may be guided downstream toward pump 120 intake. The geometry of the channels 600 of illustrative embodiments, and thus the geometry of first and second helical pathways 630, 620, may guide well fluid with improved separation efficiency and a reduced risk of reentrapped gas, as compared to conventional designs.

A plurality of teardrop shaped channels 600 may extend between and through crossover skirt 315 and crossover jacket 310. As perhaps best shown in FIG. 4 and FIG. 5, each channel 600 may be shaped like teardrop, leaf, or tapered oval, resulting in a similar shape of first helical passageway 630 enclosed inside channel 600. Channel 600 may include rounded side 610 opposite pointed side 605. Rounded side 610 may extend from skirt 315 to jacket 310 with a rounded, curved, or half-oval shape while pointed side 605 may extend from skirt 315 to jacket 310 with a pointed, sharpened, or tapered shape. The teardrop shape of each channel 600 may define upper channel surface 635, which upper channel surface 635 forms a top, supportive wall of each channel 600 and encloses the top of each first helical passageway 630. Upper channel surface 635 may extend from pointed edge 605 to rounded edge 610 on the top side of channel 600, with rounded edge 610 tilted 10-40° upward from pointed edge 605. The tilted orientation of upper channel surface 635 may guide higher density, gas poor fluid 305 upward at a 10-40° angle, thereby providing a gentle entrance and exit angle into second helical passageway 620. Three channels 600 are shown in FIGS. 6A-6D, however, more or less than three channels 600 may be employed in other embodiments, for example two, four, or six channels 600.

Figure 5:
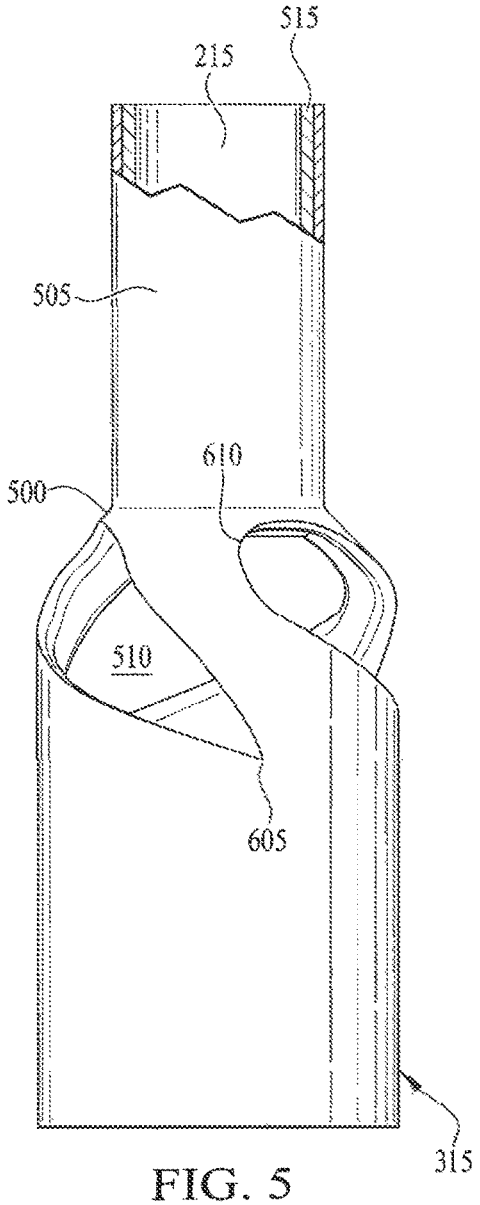
FIG. 5 is a side elevation view of an exemplary skirt of an illustrative embodiment.

Each of the plurality of teardrop shaped channels 600 may extend through skirt 315 to form channel entrance 510, which channel entrance 510 may fluidly couple first helical passageway 630 to lower density, gas rich fluid 300 inside inner chamber 325 enclosed by skirt 315. FIG. 5 shows a skirt 315 of an exemplary crossover 210 of illustrative embodiments. As shown in FIG. 5, skirt 315 includes a tubular body and a concave top portion, which concave portion extends inward as skirt 315 extends downstream. In some embodiments, skirt 315 may extend downward (upstream) further than jacket 310 so as to extend slightly into the top of separation chamber 205, as shown in FIG. 3B. Shaft aperture 500 may extend through the top of skirt 315, which shaft aperture 500 allows shalt 215 to extend centrally through crossover 210.

As shown in FIG. 5, passageway entrances 510 may be spaced around the concave (curved) top end of skirt 315. The intersection of channel 600 with skirt 315 may give each entrance 510 a teardrop shape mirroring that of channel 600. As a result of the concave top end of skirt 315, entrances 510 may curve along skirt 315, which may result in an orientation of entrances 510 directed tangentially to the helical flow path of lower density, gas rich stream 300, as shown in FIG. 6B. Positioning entrances 510 at the top, curved portion of skirt 315 may reduce turbulence and bubble coalesce. Each passageway entrance 510 may be larger in surface area than conventional apertures intended to serve a similar purpose in traditional crossovers, such as 10-70% larger.

Figure 4:
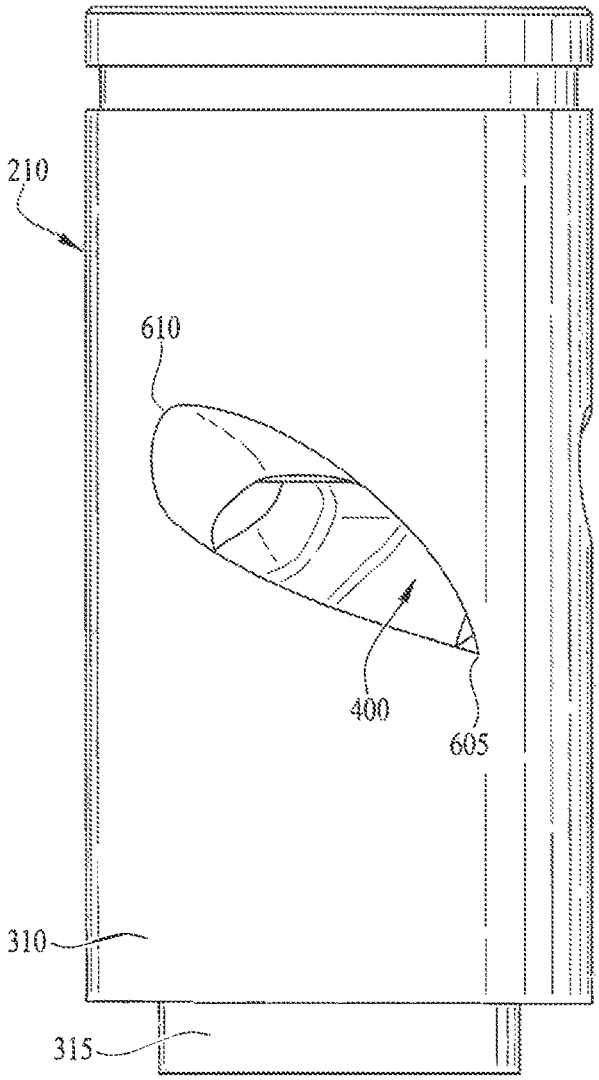
FIG. 4 is a side elevation view of an exemplary crossover of an illustrative embodiment.

Each of the plurality of teardrop shaped channels 600 may extend through jacket 310 to form exit 400, which exits 400 fluidly couple lower density, gas rich fluid 300 inside first helical passageway 630 to casing annulus 155 for ventilation. FIG. 4 shows a jacket 310 of an exemplary crossover 210 of illustrative embodiments. Crossover 210 may include tubular jacket 310 circumferentially surrounding skirt 315 with a space between them. Jacket 310 may extend axially downward from the top of crossover 210 and/or the base of pump 120 to the top of separation chamber 205. Jacket 310 may be installed directly inside housing 225 and may be coupled to housing 225 with a bolted, threaded, friction-fit, and/or similar connection so as to secure crossover 210 inside housing 225. As shown in FIG. 3B, each exit 400 may be axially aligned inward of a corresponding housing port 220, which housing ports 220 may allow ventilation into casing annulus 155. Housing ports 220 may be similarly shaped, sized, and/or oriented to that of exit 400 to allow for a continuously unimpeded flow path for gas rich fluid 300 during ventilation. In some embodiments, housing ports 220 may be larger than exits 400 to enlarge the surface area exposed to lower density, gas rich stream 300 during ventilation.

As shown in FIG. 4, exits 400 may be spaced out around jacket 310. Each exit 400 may be located near the axial center point of jacket 310, for example extending the middle fourth or middle third of jacket 310. In other embodiments, exits 400 may be above or below the center of jacket 310 and/or may extend for longer or shorter axial distances. Because exit 40) is formed at the intersection of channel 600 and jacket 310, each exit 400 may have the tilted teardrop shape of channel 600. In this way, the geometric benefits of the teardrop shapes of channel 600 and/or first helical passageway 630 may be retained throughout their lengths, moving from teardrop shaped entrances 510 to teardrop shaped exit 400.

Instead of extending from skirt 315 and approaching jacket 310 head-on (perpendicularly), each channel 600 may curve to intersect jacket 310 tangentially and form tangential intersection 640. Referring to FIGS. 6A and 6D, tangential intersection 640 may be formed by a channel 600 that curls following the tubular curve of jacket 310 so as to approach and intersect channel 600 tangentially. Tangential intersection 640 may guide lower density, gas rich fluid 300 out of exit 400 with a curved trajectory similar to the curve of channel 600, instead of a perpendicular exit path that may force abrupt turns and induce fluid turbulence. As shown in FIG. 6A, such a curved path of gas rich fluid 300 may exit first helical passageway 630 into casing annulus 155 with gas rich exit angle a, which gas rich exit angle a is the angle with which gas rich fluid 300 intersects jacket 310 when exiting through exit Gas rich exit angle a may mirror the tangential direction of channel 600's tangential intersection 640 and may serve as a gentle exit angle for lower density, gas rich fluid 300 that reduces turbulence as gas rich fluid 300 exits first helical passageway 630.

During operation, entrance 510 and exit 400 may gently guide lower density, gas rich fluid 300 into and out of first helical passageway 630 with tangential direction components that induce gentle entrance and exit angles. The curved orientation of entrances 510 along skirt 310, resulting from skirt 310's concave top section, may form a tangential component that guides lower density, gas rich fluid 300 into first helical passageway 630 with a gentle entry angle that minimizes turbulence and flow disruption. Similarly, channel 600's tangential intersection 640 may allow exit 400 to guide lower density, gas rich fluid 300 with gas rich exit angle a, which exit angle a may prevent and/or reduce flow turbulence. First helical passageway 630 may curve between entrance 510 and exit 400 and, as a result, may gently guide lower density, gas rich fluid 300 from skirt 315 to casing annulus 155, which may beneficially reduce turbulence in gas rich fluid 300. By minimizing flow turbulence and/or disruption, first helical passageways 630 of illustrative embodiments may increase separation efficiency inside gas separator 125 and/or reduce the likelihood of gas reentrapment and the resulting gas lock.

Similarly, channels 600 may define second helical passageways 620 around channels 600, which second helical passageways 620 guide higher density, gas poor fluid 305 around the outside of channel 600's teardrop shape. Similar to first helical passageway 630, second helical passageway 620 may be geometrically configured to tangentially guide gas poor fluid 305 into and out of second helical passageway 620 with gentle angles that minimize fluid turbulence and and/or abrasive wear inside crossover 210. Referring to FIG. 6D, higher density, gas poor fluid 305 may be directed helically, rotating about skirt 315 while flowing downstream. Upon reaching channel 600, higher density, gas poor fluid 305 may be guided into second helical passageway 620, following support wall 635 around the top of channel 600 at a 10-40° angle. Higher density, gas poor fluid 305 may contact pointed side 605, which pointed side 605 of channel 600 may gently guide gas poor fluid 305 into second helical passageway 620 through the space above channel 600. The small surface area of pointed side 605 may minimize the contact area between channels 600 and gas poor fluid 305, thereby reducing fluid collisions that cause turbulence and/or abrasive wear.

As described herein, upper channel surface 635 may tilt upward 10-40° as support wall 635 extends from pointed side 605 to rounded edge 610 on the top side of channel 600. Further, upper channel surface 635 may curve around skirt 315, following the curved shape of skirt 315's concave surface. During operation, higher density, gas poor fluid 305 may be guided upward with an angle of 10-40° while curving naturally about skirt 315, as shown in FIGS. 6C-6D. Higher density, gas poor fluid 305 may follow upper channel surface 635 and/or second helical passageway 620 up and around skirt 315 at which time gas poor fluid 305 may exit second helical passageway 620 through the space above rounded side 610. By concurrently tilting upward and curving around skirt 315 in a helical fashion, second helical passageway 620 may be oriented with a tangential component that mirrors the natural flow path of higher density, gas poor fluid 305 induced during centrifugal separation. In this way, higher density, gas poor fluid 305 may be guided through second helical passageway 620 with gentle entry and exit angles that reduce disruption to gas poor fluid 305's flow, thereby reducing and/or preventing turbulence and abrasive wear.

The helical trajectory of higher density, gas poor fluid 305, while beneficial for separation, may include a pre-rotation component that, if maintained when delivered to pump 120, may degrade the efficiency and production rate of pump 120. Illustrative embodiments may include an improved spider bearing 700, which spider bearing 700 serves to reduce and/or prevent pre-rotation of fluid while providing radial support to shaft 215.

Figure 6E:
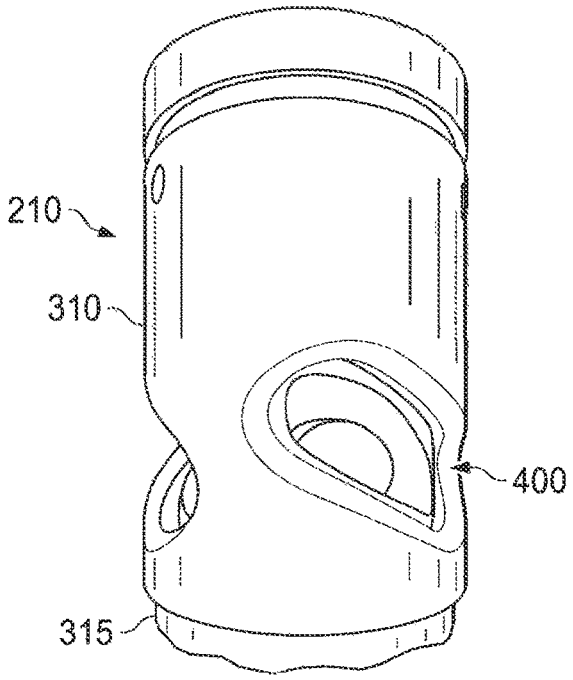
FIG. 6E is a perspective view of an exemplary crossover with adjustable jacket of an illustrative embodiment.
Figure 6F:
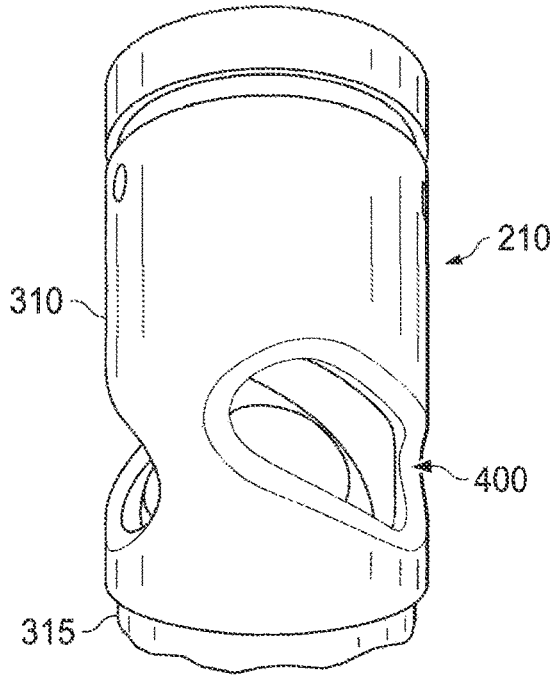
FIG. 6F is another perspective view of an exemplary crossover with adjustable jacket of an illustrative embodiment.
Figure 6G:
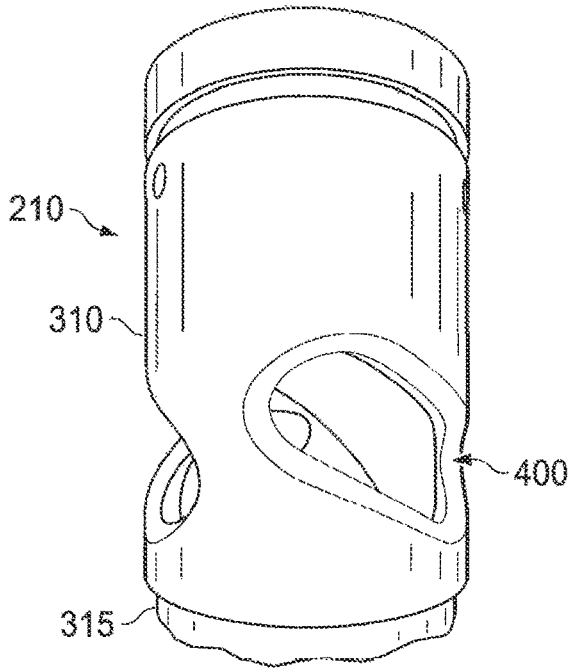
FIG. 6G is yet another perspective view of an exemplary crossover with adjustable jacket of an illustrative embodiment.

The position of the jacket 310 with respect to the skirt 315 can be adjusted. The jacket 310 can be rotated about the skirt 315 to control the volume of the fluids through the exits 400. In some applications, the flow rate of the pump 120 can cause fluids to enter the separator 125 through the exits 400. As such, the ability to adjust the jacket 310 to control the volume of fluid through the exits 400 can improve the overall functionality of the crossover 210. The design also lends itself to being a flow control in applications where the fluid moving capability of the separator 125 is much greater than the pump requirement and therefore opened for greater flow exiting the separator 125 before reaching the pump 120. FIGS. 6E-6G illustrate the jacket 310 in a first position, FIG. 6E, to allow for maximum flow through exits 400, a second position, FIG. 6F, to allow for a partially flow through exits 400, and a third position, FIG. 6G, to allow for minimum flow through the exits 400. The jacket 310 of the crossover 210 can be made from proven bonded material such as stainless steel, which has the strength to withstand the harsh operating conditions of a downhole well.

Figure 6H:
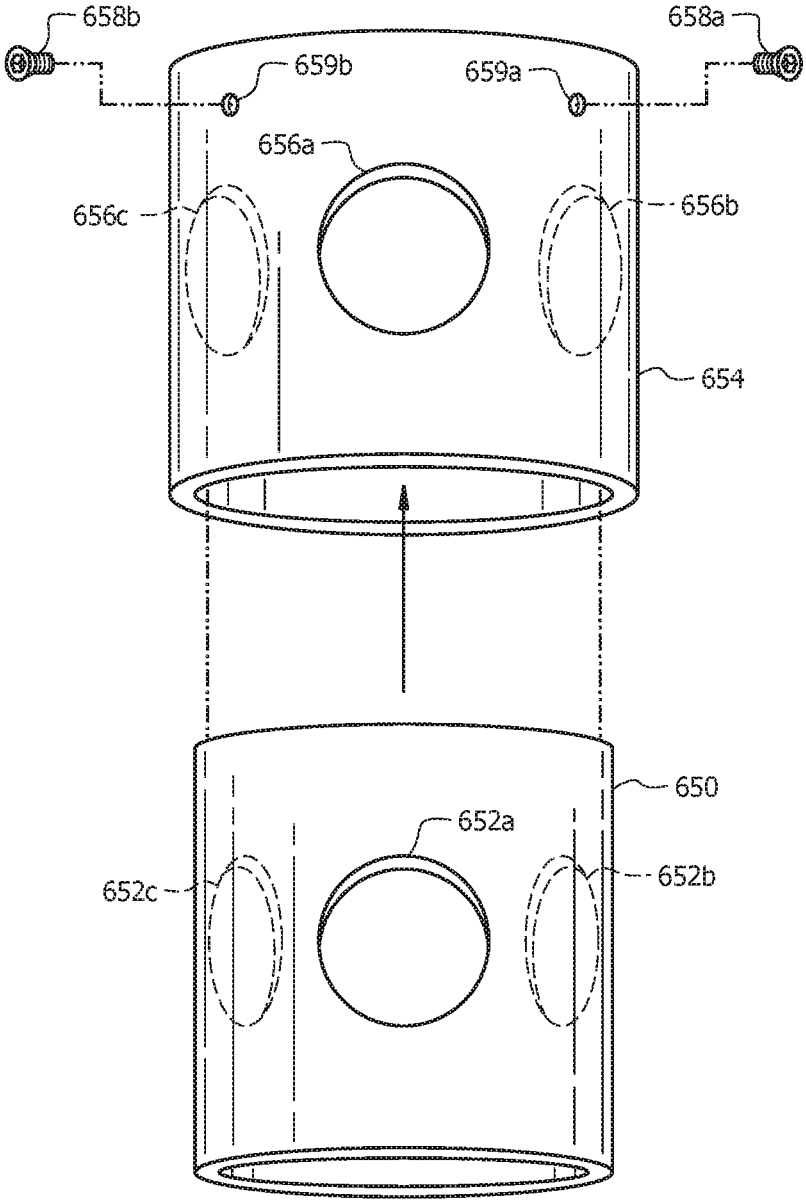
FIG. 6H is another adjustable jacket and skirt of a crossover of an illustrative embodiment.

Turning now to FIG. 6H, an alternate embodiment of the crossover 210 is described. In an embodiment, the crossover 210 comprises a skirt 650 and a jacket 654. The skirt 650 defines a second plurality of exits 652, for example a first exit 652*a*, a second exit 652*b*, and a third exit 652*c*. The jacket 654 defines a third plurality of exits 656, for example a fourth exit 656*a*, a fifth exit 656*b*, and a sixth exit 656*c*. The skirt 650 may define more or fewer than three exits. The jacket 654 may define more or fewer than three exits. In an embodiment, the skirt 650 and the jacket 654 define the same number of exits. In another embodiment, however, the skirt 650 and the jacket 654 may define a number of exits that is different from each other. When assembled to form the crossover 210, the jacket 654 is disposed over and/or around the outside of the skirt 650 (e.g., the jacket 654 circumferentially surrounds the skirt 650), and the skirt 650 and the jacket 654 are substantially concentric with each other and with a centerline of the ESP assembly. While illustrated as circular in shape, the exits 652, 656 may take other shapes including teardrop shaped, oval shaped, oblong shaped, rectangularly shaped, trapezoidally shaped, or other shapes.

While not shown in FIG. 6H, the second plurality of exits 652 may be associated with channels that may be in fluid communication with an interior of the crossover 210 (e.g., in fluid communication with the inner chamber 325), whereby to exhaust gas laden fluid (e.g., fluid having a high gas volume fraction) from the gas separator 125 into the wellbore 155. The crossover 210 having the skirt 650 and jacket 654 described herein may be applied in the gas separator 125 described above having teardrop shaped helical channels—one set of channels to direct higher density fluid (e.g., lower gas volume fraction) to the charge pump 150 and/or to the ESP pump 120, the other channels to direct lower density fluid (e.g., higher gas volume fraction) to the exits 652. Alternatively, in an embodiment, the skirt 650 and jacket 654 described herein may advantageously be combined with conventional crossovers of conventional gas separators that do not feature teardrop shaped channels.

In an embodiment, the skirt 650 is coupled to the crossover 210, and the jacket 654 is rotatably coupled to the skirt 650. Alternatively, the skirt 650 is integral with the crossover 210 (e.g., is a part of the crossover 210, for example the skirt 650 is a feature of a casting which is the crossover 210), and the jacket 654 is rotatably coupled to the skirt 650. For example, the jacket 654 may have an inside diameter that is slightly larger than an outside of the skirt 650 and be disposed over the outside of the skirt 650. In an embodiment, an inside diameter of the jacket 654 is less than 0.5 inch, 0.25 inch, 0.1 inch, 0.05 inch, 0.025 inch, or 0.01 inch greater than an outside diameter of the skirt 650. Said in other words, the jacket 654 can be rotated about the stationary skirt 650 (e.g., rotated about a centerline of the jacket 654, of the skirt 650, and of the ESP assembly 100) to adjust an offset between the second exits 652 and the third exits 656, whereby to adjust an opening for fluid to exit from the gas separator 125 into the wellbore 155. As the jacket 654 is rotated in a first sense about the centerline of the ESP assembly 100, the second exits 652 of the skirt 650 are occluded by the jacket 654, effectively reducing an aggregate exit area of the crossover 210. Rotating the jacket 654 in the opposite sense decreases the occlusion of the second exits 652 by the jacket 654, effectively increasing the aggregate exit area of the crossover 210.

The rotation of the jacket 654 relative to the skirt 650 (e.g., the offset between the second exits 652 and the third exits 656) can be manually adjusted by a human operator at a manufacturing facility. The rotation of the jacket 654 relative to the skirt 650 can be manually adjusted by a human operator proximate the wellbore 155, for example at the surface during make-up of the ESP assembly 100. The rotation of the jacket 654 relative to the skirt 650 may be adjusted by a powered mechanical tool or actuator, either at the surface or while the ESP assembly 100 is disposed downhole in the wellbore 155. Rotation of the jacket 654 relative to the skirt 650 by an actuator while the ESP assembly 100 is disposed in the wellbore 155 is described further below with reference to FIG. 6T, FIG. 6U, and FIG. 6V.

The jacket 654 may be formed of metal such as iron, steel, stainless steel, carbide metal, titanium, or another metal. The skirt 650 may be formed of metal such as iron, steel, stainless steel, carbide metal, titanium, or another metal. In an embodiment, the jacket 654 and the skirt 650 may be formed of the same metal. In another embodiment, however, the jacket 654 and the skirt 650 may be formed of different metals. In an embodiment, the skirt 650 is a part of the crossover 210, for example the crossover 210 may be fabricated as a casting, and the skirt 650 may be a structural feature of the casting.

In an embodiment, the jacket 654 defines a plurality of threaded through-holes 659 and is secured rotationally to the skirt 650 by a first set screw 658*a* in a first threaded through-hole 659*a* and a second set screw 658*b* in a second threaded through-hole 659*b*. It is understood that the jacket 654 may be secured rotationally to the skirt 650 by any number of set screws 658 in a corresponding number of threaded through-holes 659. In another embodiment, the jacket 654 may be rotationally secured to the skirt 650 by other attachment hardware. In an embodiment, the skirt 650 may define a plurality of concave indentations (e.g., a continuous or discontinuous channel) to receive the stem of the set screws at specific rotational offsets from the full-open exit rotational position of the jacket 654, for example at a 0 degree offset, a 5 degree offset, at a 10 degree offset, at a 15 degree offset, at a 20 degree offset, at a 25 degree offset, at a 30 degree offset, at a 35 degree offset, at a 40 degree offset, at a 45 degree offset, and at a 50 degree offset. In another embodiment, different offset positions may be supported by the indentations defined by the skirt 650. Securing the jacket 654 using set screws 658 aligned with indentations in the skirt 650 may secure the jacket 654 more reliably because sliding of the set screw contact points on a smooth exterior surface of the skirt 650 may be avoided.

Figure 6I:
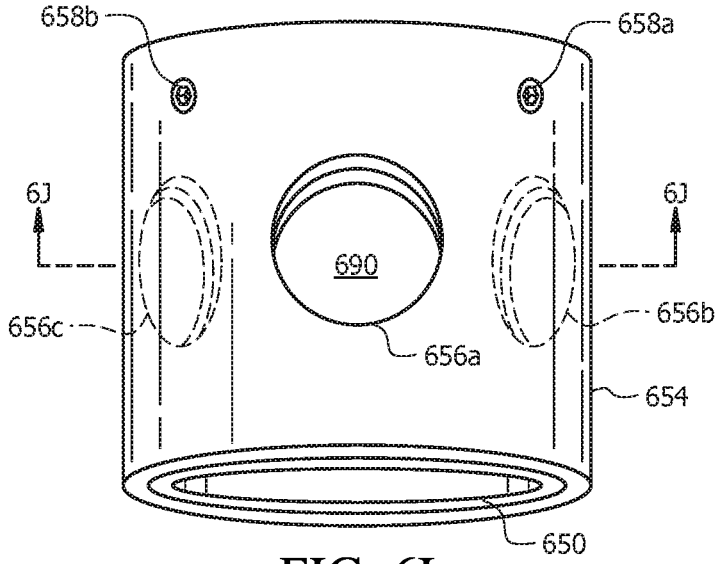
FIG. 6I is an illustration of an adjustable jacket disposed over a skirt of a crossover in a first rotational alignment of an illustrative embodiment.
Figure 6J:
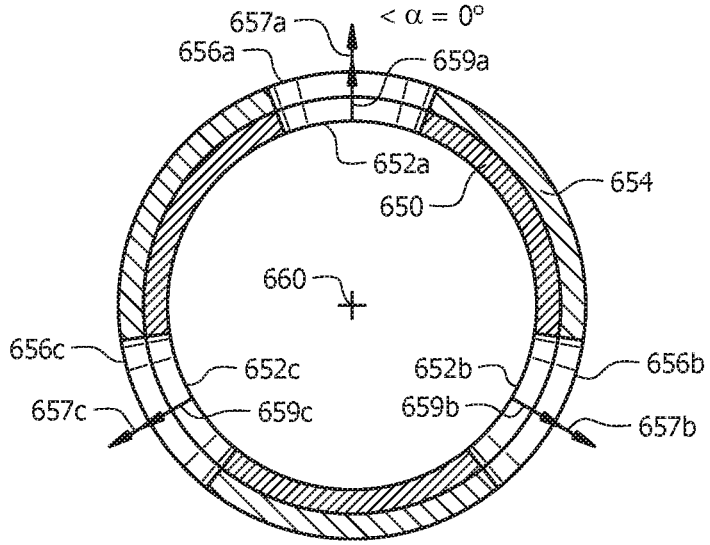
FIG. 6J is a cross-section view of the adjustable jacket disposed over the skirt of the crossover in the first rotational alignment of an illustrative embodiment.

Turning now to FIG. 6I and FIG. 6J, a first rotational alignment of the jacket 654 with the skirt 650 is described. In FIG. 6I and FIG. 6J, the exits 656 are substantially aligned with the exits 652. In this rotational alignment, the maximum exit area 690 is provided for exhausting gas laden fluid into the wellbore 155. As best seen in FIG. 6J, in this rotational alignment, the exits 656*a*, 656*b*, 656*c* line up with the exits 652*a*, 652*b*, and 652*c* respectively. A first radius 657*a* extending from a centerline 660 common to the skirt 650 and jacket 654 through a center of the fourth exit 656*a* makes an angle a of 0 degrees with a second radius 659*a* extending from the centerline 660 through a center of the first exit 652*a*. A third radius 657*b* extending from the centerline 660 through a center of the fifth exit 656*b* makes the same angle a with a fourth radius 659*b* extending from the centerline 660 through a center of the second exit 652*b*. A fifth radius 657*c* extending from the centerline 660 through a center of the sixth exit 656*c* makes the same angle a with a sixth radius 659*c* extending from the centerline 660 through a center of the third exit 652*c*. In an embodiment, the first radius 657*a* is offset about 120 degrees from the third radius 657*b* and offset about 240 degrees (or alternatively −120 degrees) from the fifth radius 657*c*. In an embodiment, the second radius 659*a* is offset about 120 degrees from the fourth radius 659*b* and offset about 240 degrees (or alternatively −120 degrees) from the sixth radius 659*c*.

Figure 6K:
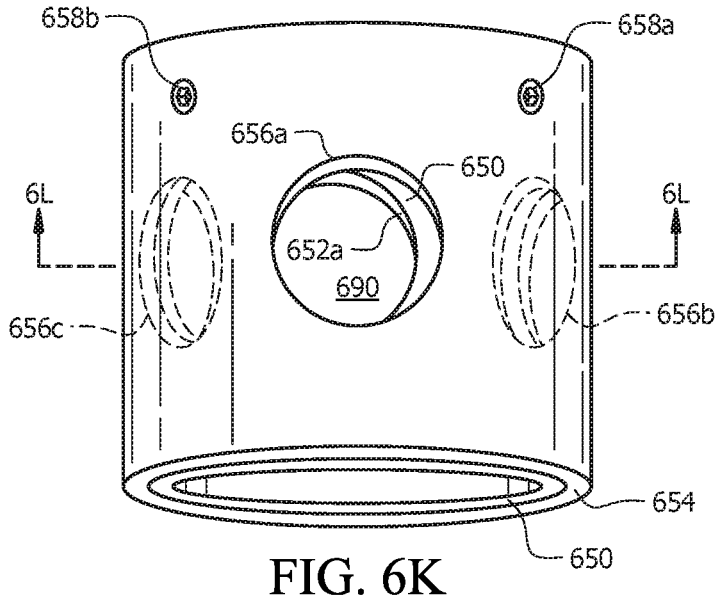
FIG. 6K is an illustration of the adjustable jacket disposed over the skirt of the crossover in a second rotational alignment of an illustrative embodiment.
Figure 6L:
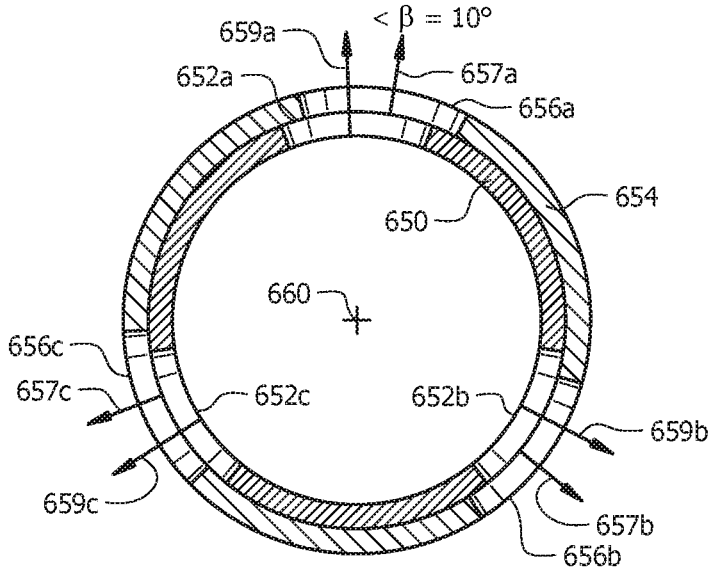
FIG. 6L is a cross-section view of the adjustable jacket disposed over the skirt of the crossover in the second rotational alignment of an illustrative embodiment.

Turning now to FIG. 6K and FIG. 6L, a second rotational alignment of the jacket 654 with the skirt 650 is described. In FIG. 6K and FIG. 6L, the exits 656 are offset by about 10 degrees with reference to the exits 652. In this second rotational alignment, the interior surface of the jacket 654 slightly occludes the exits 652, slightly reducing the exit area 690 for exhausting gas laden fluid into the wellbore 155. As an approximation, the exit area provided by the second rotational alignment may be about 90% of the exit area provided by the first rotational alignment. As best seen in FIG. 6L, in this second rotational alignment, the exits 656*a*, 656*b*, 656*c* are slightly misaligned with the exits 652*a*, 652*b*, 652*c* respectively. The first radius 657*a* makes an angle 3 of about 10 degrees with the second radius 659*a*. The third radius 657*b* makes the same angle 3 with the fourth radius 659*b*. The fifth radius 657*c* makes the same angle 3 with the sixth radius 659*c*.

Figure 6M:
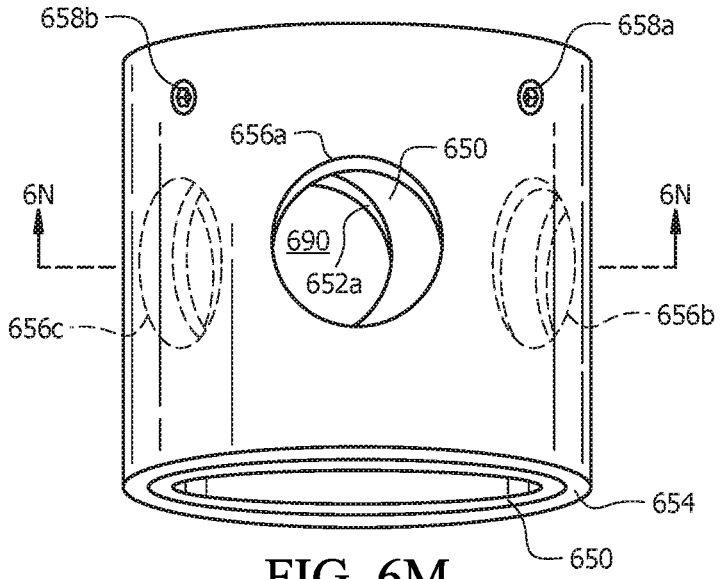
FIG. 6M is an illustration of the adjustable jacket disposed over the skirt of the crossover in a third rotational alignment of an illustrative embodiment.
Figure 6N:
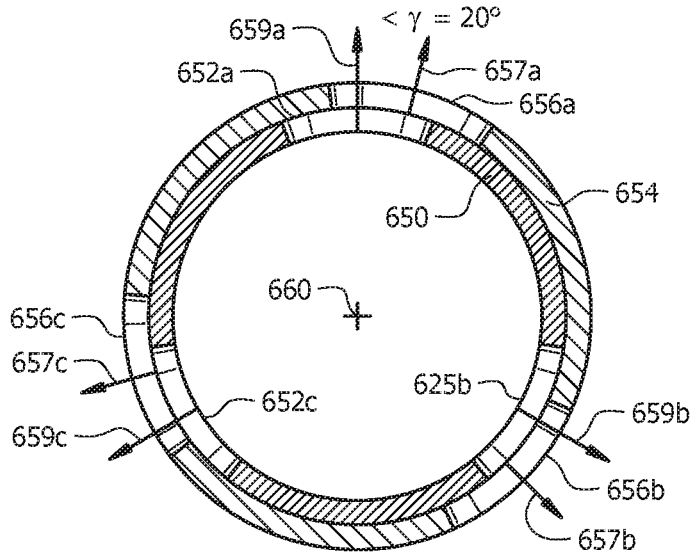
FIG. 6N is a cross-section view of the adjustable jacket disposed over the skirt of the crossover in the third rotational alignment of an illustrative embodiment.

Turning now to FIG. 6M and FIG. 6N, a third rotational alignment of the jacket 654 with the skirt 650 is described. In FIG. 6M and FIG. 6N, the exits 656 are offset by about 20 degrees with reference to exits 652. In this third rotational alignment, the interior surface of the jacket 654 moderately occludes the exits 652, moderately reducing the exit area 690 provided for exhausting gas laden fluid into the wellbore 155. As an approximation, the exit area provided by the third rotational alignment may be about 66% of the exit area provided by the first rotational alignment. As best seen in FIG. 6N, in this third rotational alignment, the exits 656*a*, 656*b*, 656*c* are moderately misaligned with the exits 652*a*, 652*b*, 652*c* respectively. The first radius 657*a* makes an angle γ of about 20 degrees with the second radius 659*a*. The third radius 657*b* makes the same angle γ with the fourth radius 659*b*. The fifth radius 657*c* makes the same angle γ with the sixth radius 659*c*.

Figure 6O:
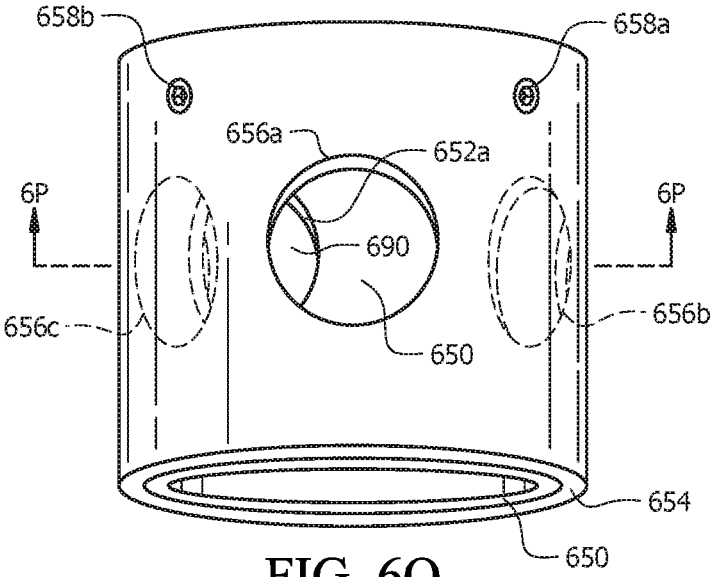
FIG. 6O is an illustration of the adjustable jacket disposed over the skirt of the crossover in a fourth rotational alignment of an illustrative embodiment.
Figure 6P:
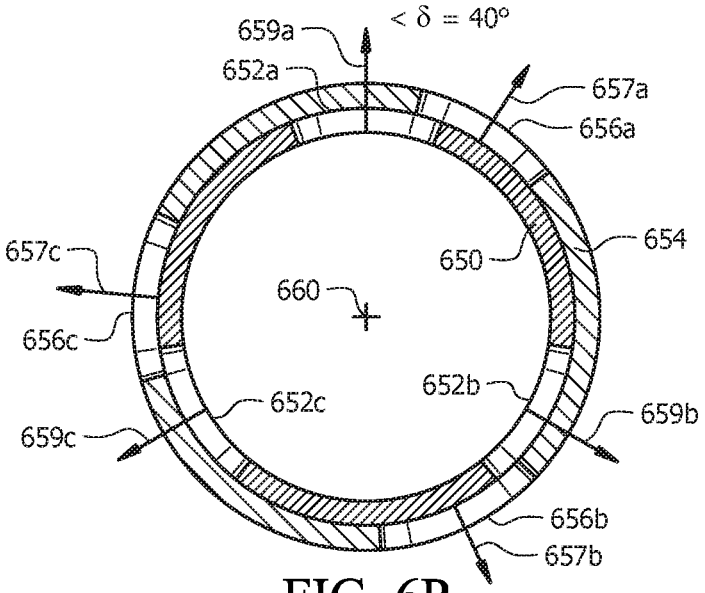
FIG. 6P is a cross-section view of the adjustable jacket disposed over the skirt of the crossover in the fourth rotational alignment of an illustrative embodiment.
Figure 6Q:
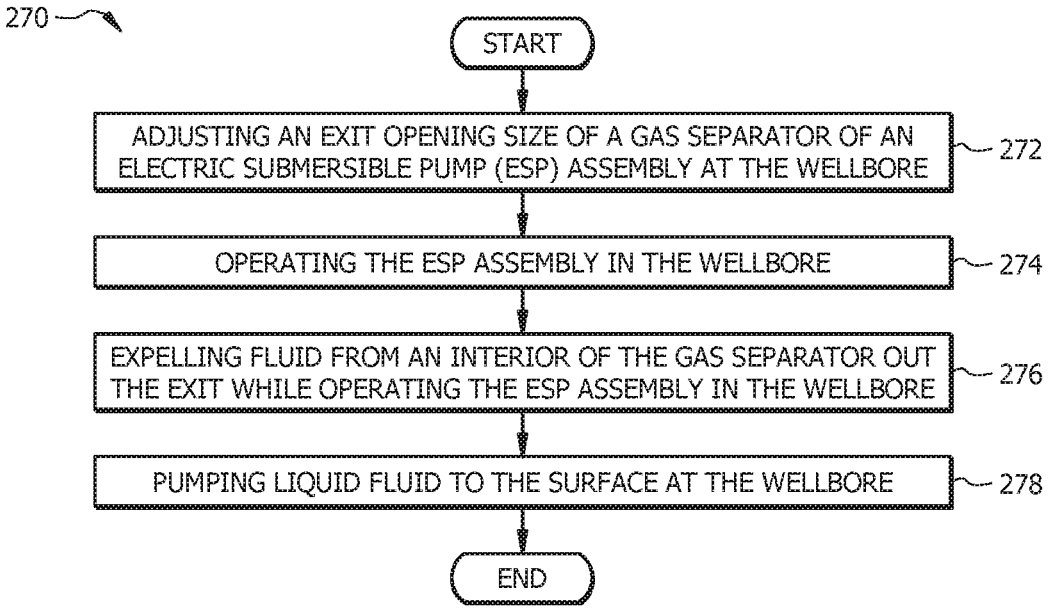
FIG. 6Q is a flow chart of a method according to an illustrative embodiment.

Turning now to FIG. 6O and FIG. 6P, a fourth rotational alignment of the jacket 654 with the skirt 650 is described. In FIG. 6O and FIG. 6P, the exits 656 are offset by about 40 degrees with reference to exits 652. In this fourth rotational alignment, the interior surface of the jacket 654 greatly occludes the exits 652, greatly reducing the exit area 690 provided for exhausting gas laden fluid into the wellbore 155. As an approximation, the exit area provided by the fourth rotational alignment may be about 20% of the exit area provided by the first rotational alignment. As best seen in FIG. 6Q, in this third rotational alignment, the exits 656*a*, 656*b*, 656*c* are greatly misaligned with the exits 652*a*, 652*b*, 652*c* respectively. The first radius 657*a* makes an angle S of about 40 degrees with the second radius 659*a*. The third radius 657*b* makes the same angle S with the fourth radius 659*b*. The fifth radius 657*c* makes the same angle S with the sixth radius 659*c*. FIG. 6O and FIG. 6P represent a minimum exit area 690 for exhausting gas laden fluid into the wellbore 155.

While example rotational alignments of 0 degree offset, 10 degree offset, 20 degree offset, and 40 degree offset were illustrated and described above with reference to FIG. 6I, FIG. 6H, FIG. 6J, FIG. 6K, FIG. 6L, FIG. 6M, FIG. 6N, FIG. 6O, and FIG. 6P, it is understood that the jacket 654 may be rotated about centerline 660 and secured to hold other rotational alignments than these few examples. As described above with reference to FIG. 6E, FIG. 6F, and FIG. 6G, the adjustment of the rotational alignment of the jacket 654 with respect to the skirt 650 may provide multiple benefits and advantages in different operating environments. The ability to adjust the rotational alignment of the jacket 654 with the skirt 650 can be used to control the volume of fluid through the exits 652, 656 to improve the overall functionality of the crossover 210. The adjustable rotational alignment feature of the jacket 654 and the skirt 650 lends itself to being a flow control in applications where the fluid moving capability of the gas separator 125 is greater than the pump requirement and therefore opened for greater flow exiting the separator 125 before reaching the pump 120. Additionally, the adjustable rotational alignment feature of the jacket 654 and the skirt 650 allows the same crossover 210 device to be used for different operating companies who may have different preferences, philosophies, and policies for completing and producing their wells.

Turning now to FIG. 6Q, a method 270 is described. In an embodiment, the method 270 is a method of producing liquid fluid from a wellbore. At block 272, the method 270 comprises adjusting an exit opening size of a gas separator of an electric submersible pump (ESP) assembly at the wellbore. In an embodiment, the processing of block 272 comprises rotating a portion of the gas separator relative to a centerline of the gas separator. The portion of the gas separator that is rotated may be the jacket 654 described above, and the jacket 654 may be rotated relative to the skirt 650. The portion of the gas separator may be rotated by a tool operated by a human being or by a power tool operated by a human being or by a power tool responsive to a computerized command. The processing of block 272 may be accomplished in a manufacturing facility in conformance with a specified exit opening size provided by a customer or well operator. Alternatively, the processing of block 272 may be accomplished on location at a well site, for example during assembly of the ESP assembly 100 and/or during operation of the ESP assembly 100 after being placed in the wellbore 155. The processing of block 272 may be said to adjust the gas separator or to adjust an exit (e.g., increase or decrease a surface area of one or more exits) of the gas separator.

At block 274, the method 270 comprises placing the ESP assembly in the wellbore and operating the ESP assembly in the wellbore. At block 276 the method 270 comprises expelling fluid from an interior of the gas separator out the exit while operating the ESP assembly in the wellbore. The processing of block 276 may comprise expelling a fraction of the fluid entering the gas separator, where the fraction depends on the rotating of the portion of the gas separator provided by the processing of block 272. At block 278, the method 270 comprises pumping liquid fluid to the surface at the wellbore via the ESP assembly 100.

Figure 6R:
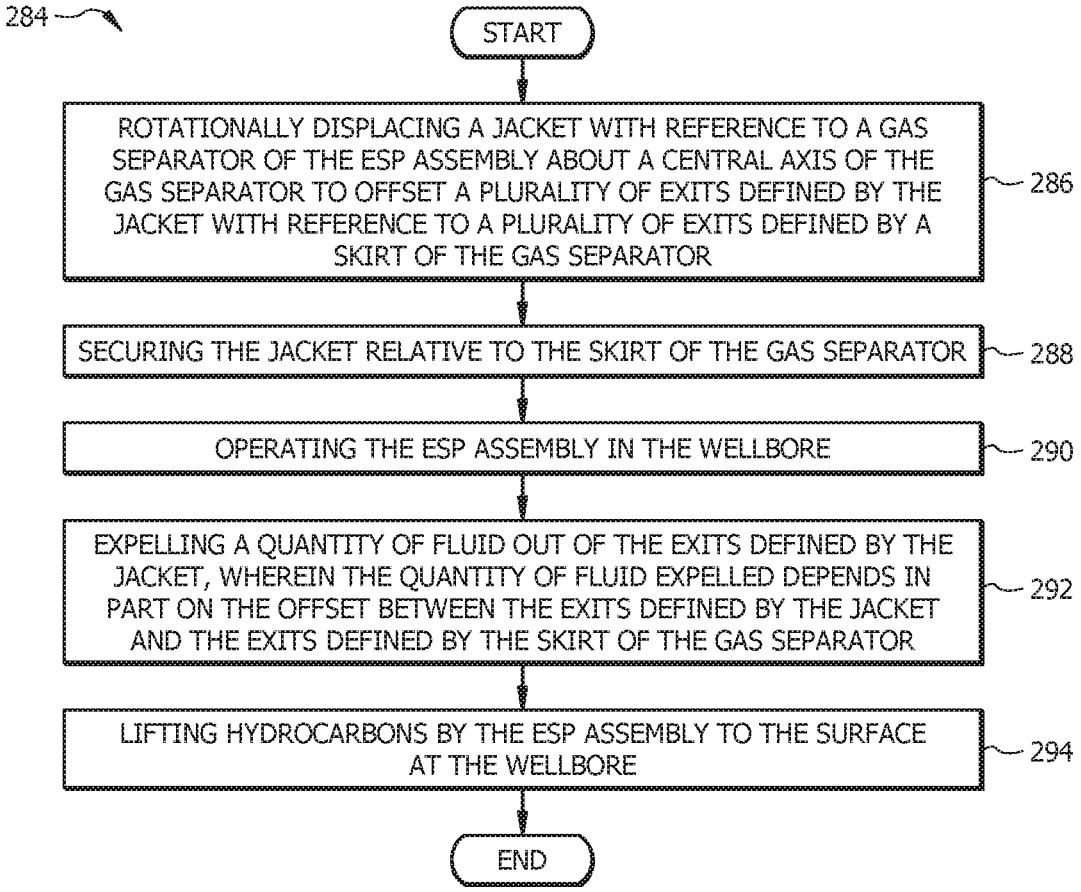
FIG. 6R is a flow chart of another method according to an illustrative embodiment.

Turning now to FIG. 6R, a method 284 is described. In an embodiment, the method 284 is a method of producing hydrocarbons by an electric submersible pump (ESP) assembly from a wellbore. At block 286, the method 284 comprises rotationally displacing a jacket with reference to a gas separator of the ESP assembly about a central axis of the gas separator to offset a plurality of exits defined by the jacket with reference to a plurality of exits defined by a skirt of the gas separator. The processing of block 286 may establish an alignment between the exits of the jacket 654 and the exits of the skirt 650 such that the jacket provides a reduced exit area that is about 90% of a maximum exit area of the jacket exits, about 66% of the maximum exit area of the jacket exits, about 20% of the maximum area of the jacket exits, or some other fraction of the maximum area of the jacket exits.

At block 288, the method 284 comprises securing the jacket relative to the skirt of the gas separator. Securing the jacket to the skirt may comprise tightening set screws installed into corresponding threaded through-holes in the jacket Securing the jacket to the skirt may further comprise aligning the set screws (e.g., adjusting the rotation of the jacket relative to the skirt) with corresponding concave indentations defined by a surface of the skirt of the gas separator. At block 290, the method 284 comprises placing the ESP assembly in the wellbore and operating the ESP assembly in the wellbore. At block 292, the method 284 comprises expelling a quantity of fluid out of the exits defined by the jacket, wherein the quantity of fluid expelled depends in part on the offset between the exits defined by the jacket and the exits defined by the skirt of the gas separator. At block 294, the method 284 comprises lifting hydrocarbons by the ESP assembly 100 to the surface at the wellbore.

Figure 6S:
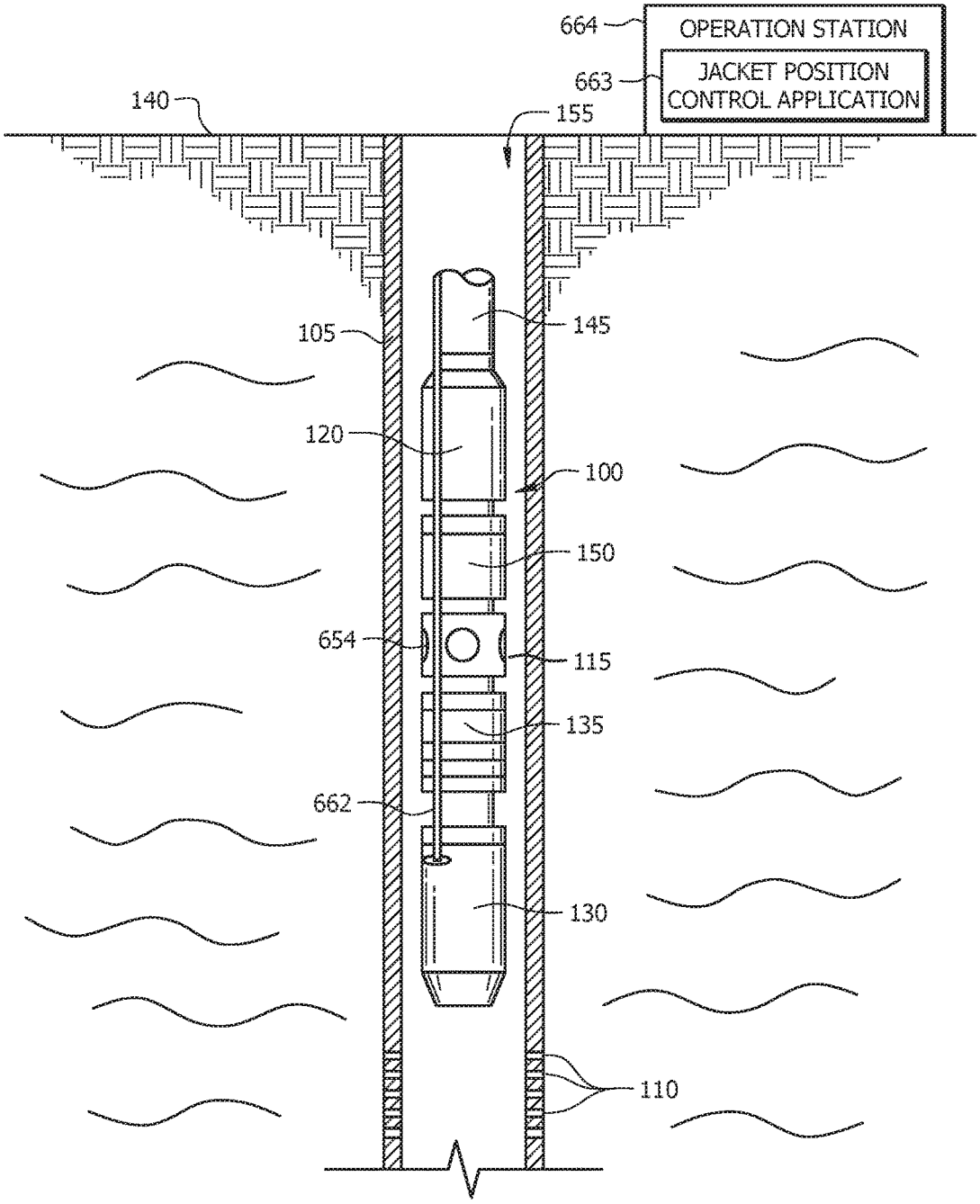
FIG. 6S is an illustration of an ESP assembly according to an illustrative embodiment.

Turning now to FIG. 6S, an operation station 664 executing a jacket position control application 663 is described. In an embodiment, the rotation of the jacket 654 relative to the skirt 650 may be adjusted by sending rotational position commands from an operation station 664 located proximate the wellbore 155 to the gas separator 125 and/or to the jacket 654. For example, the position commands may be conveyed from the operation station to the gas separator 125 and/or to the jacket 654 via an electric power cable 662 or via a wireless link.

Figure 6T:
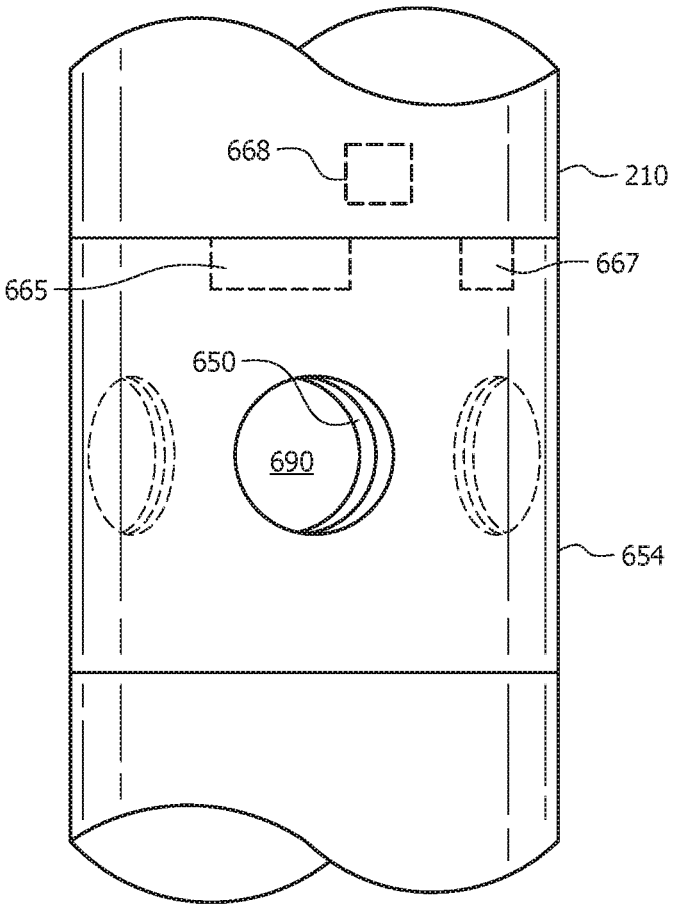
FIG. 6T is an illustration of a portion of an ESP assembly according to an illustrative embodiment.

Turning now to FIG. 6T, further details are provided. In an embodiment, the jacket 654 may comprise an actuator 665 that causes the jacket 654 to rotate clockwise and counterclockwise around the skirt 650 in response to control inputs such that the exit area 690 may be adjusted (e.g., increased or decreased) while the ESP assembly 100 is located in wellbore 100, for example in response to commands from the operation station 664 located at the surface 140. The actuator 665 may be an electric actuator such as an electric lead screw or may be a hydraulic actuator. The actuator 665 may respond to commands that are continuous in nature, such that the actuator 665 rotates the jacket 654 as long as the command is active and stops rotating the jacket 654 when the command is inactive. Alternatively, the actuator 665 may respond to a command that identifies a desired rotational position, and the actuator 665 responds by driving the jacket 654 to the commanded position. In an embodiment, the jacket 654 comprises a position sensor 667 that produces and sends an indication of the rotational position of the jacket 654 to the operation station 664, for example via the electric power cable 662 or via a wireless communication link. In an embodiment, the position sensor 667 produces an indication of the rotational offset between the jacket 654 and the skirt 650 and sends this indication to the operation station 664. In an embodiment, the position sensor 667 is a synchro position sensor wherein a portion of the synchro is fixed to the jacket 654 and a portion of the synchro is fixed to the skirt 650. In another embodiment, however, a different type of position sensor may be used. In an embodiment, the actuator 665 and the position sensor 667 are integrated, for example in the form of a servomotor.

In an embodiment, the operation station 664 receives an indication of the rotational position of the jacket 654 and/or an indication of the rotational position of the jacket 654 relative to the skirt 650, and an operator can use the operation station 664 to command the actuator 665 to rotate the jacket 654, either clockwise or counterclockwise, to achieve a commanded rotational position. The operation station 664 may monitor the rotational position feedback from the jacket 654 (e.g., information sent by the position sensor 667) and issue command signals to an actuator coupled to the jacket 654 to drive the rotational position of the jacket 654 to the commanded position automatically. In other words, in an embodiment, the human operator can input a desired rotational position of the jacket 654 into an interface of the operation station 664, and the operation station 664 monitors the rotational position of the jacket 654 and automatically commands the actuator 665 to drive the jacket 654 to the rotational position input by the human operator.

In an embodiment, the jacket 654 and/or the skirt 650 comprise stops that restrict the rotational range of movement of the jacket 654 relative to the skirt 650. A first stop may limit the rotation in a first rotational sense to the position at which the exits 652, 656 are aligned with each other (e.g., a maximum aggregate exit area 690 of the crossover 210), and a second stop may limit the rotation in a second rotational sense to the position at which the aggregate exit area 690 of the crossover 210 first becomes zero (e.g., when the jacket 654 first blocks the second exits 652). Alternatively, the second stop may limit the rotation in the second rotational sense to the position at which the aggregate exit area 690 of the crossover 210 is at a predefined minimum area.

In an embodiment, an sensor 668 located proximate an outlet of the crossover 210 provides an indication of pressure at the outlet of the crossover 210 or an indication of fluid flow rate at the outlet of the crossover 210 to the operation station. The operation station 664 may cause the ESP assembly 100 to operate in its completion disposition. While operating the ESP assembly 100, the operation station 664 may command the actuator 665 to rotate the jacket 654 to a full-open position (at the first stop, where the second exits 652 and third exits 656 are aligned) and capture a first indication output by the sensor 668 at the outlet of the crossover 210 while the jacket 654 is rotated into the first stop. While continuing to operate the ESP assembly 100, the operation station 664 may then command the actuator 665 to rotate the jacket 654 to the full-closed position (at the second stop, where the jacket 654 occludes or blocks the second exits 652) and capture a second indication output by the sensor 668 at the outlet of the crossover 210 while the jacket 654 is rotated into the second stop. The operation station 664, after this calibration procedure, may then use the indication output by the sensor 668 at the outlet of the crossover 210 as a proxy for a rotational position of the jacket 654 relative to the skirt 650. For example, the indication output by the sensor 668 at the outlet of the crossover 210 may be mapped to the full-open position and the full-closed position and intermediate rotational positions by a process of interpolating between the known sensor output at the two rotational limits. This proxy for rotational position may then be used by the operation station 664 to command the actuator 665 to drive the jacket 654 to a desired position.

Additionally or alternatively, one or more parameters sensed by sensor 668 (e.g., pressure, temperature, flow rate, etc.) may be used to monitor and/or evaluate an operational condition of the ESP assembly 100, for example if the ESP assembly 100 is operating at a suboptimal condition due to excessive gas flow or buildup in the ESP assembly 100 (e.g., at or nearing a gas lock condition in a pump of the ESP assembly 100). Responsive to a sensed parameter indicating a suboptimal or undesired operating condition of the ESP assembly 100, the operation station 664 may be used to adjust (e.g., increase or decrease) the exit area 690 of the crossover 210 in an effort to correct, minimize or alleviate the suboptimal or undesired operating condition of the ESP assembly 100, for example by increasing an amount of gas laden fluid passed into the wellbore and thereby reducing an amount of gas laden fluid passed to a pump of the ESP assembly 100.

Figure 6U:
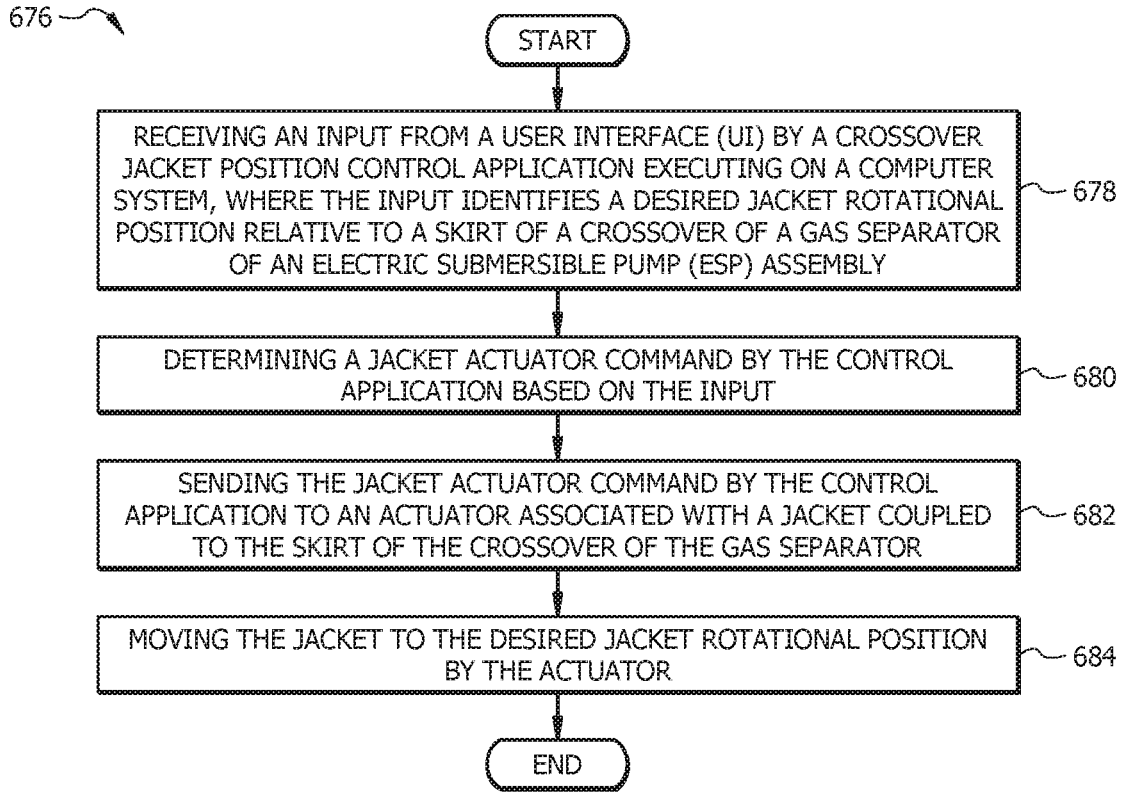
FIG. 6U is a flowchart of yet another method according to an illustrative embodiment.

Turning now to FIG. 6U, a method 676 is described. In an embodiment, the method 676 is a method of producing hydrocarbons by an electric submersible pump (ESP) assembly. In an embodiment, the method 676 is a method of lifting reservoir fluid to a wellhead positioned above a wellbore by an ESP assembly. At block 678, the method 676 comprises receiving an input from a user interface (UI) by a crossover jacket position control application executing on a computer system, where the input identifies a desired jacket rotational position relative to a skirt of a crossover of a gas separator of an electric submsersible pump (ESP) assembly. The input may identify a rotational position, for example a 5 degree, a 10 degree, a 15 degree, a 20 degree, a 25 degree, a 30 degree, a 35 degree, a 40 degree, a 45 degree offset of the jacket position relative to the skirt. Such input may be received responsive to one or more sensed parameters indicating a suboptimal or undesired operating condition of the ESP assembly 100 as discussed herein.

At block 680 the method 676 comprises determining a jacket actuator command by the control application based on the input. The processing of block 680 may comprise monitoring a position indication from a sensor coupled to the jacket that indicates a rotational position of the jacket relative to the skirt. At block 682, the method 676 comprises sending the jacket actuator command by the control application to an actuator associated with a jacket coupled to the skirt of the crossover of the gas separator. At block 684, the method 676 comprises moving the jacket to the desired jacket rotational position by the actuator.

Figure 6V:
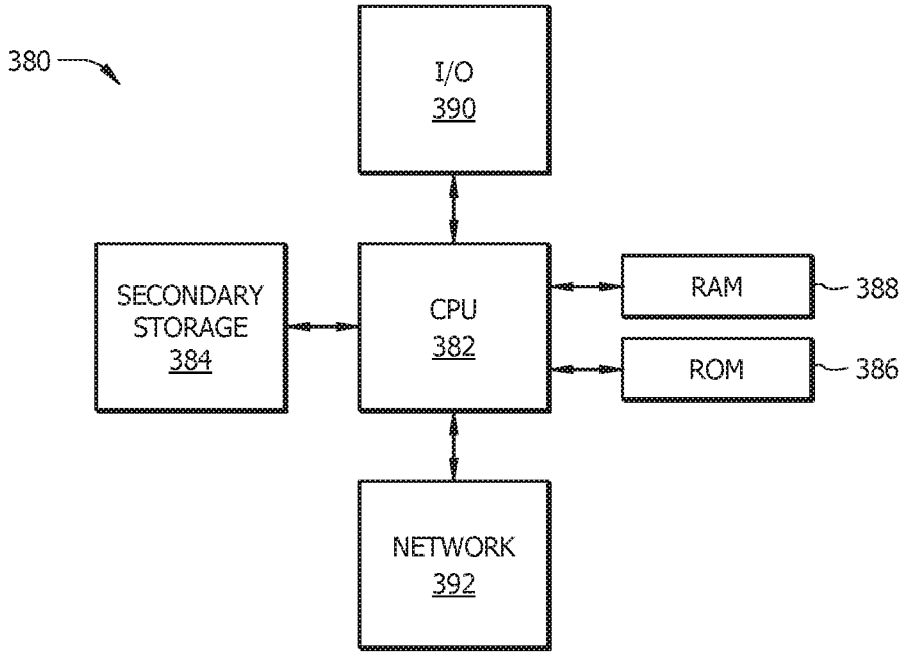
FIG. 6V is a block diagram of a computer system according to an illustrative embodiment.

Turning now to FIG. 6V, a computer system 380 suitable for implementing one or more embodiments disclosed herein. For example a computer having some of the components of the computer system 380 may be used to execute the jacket position control application 663 executing on the operation station 664. Said in other words, the operation station 664 may comprise the computer system 380. The computer system 380 includes a processor 382 (which may be referred to as a central processor unit or CPU) that is in communication with memory devices including secondary storage 384, read only memory (ROM) 386, random access memory (RAM) 388, input/output (I/O) devices 390, and network connectivity devices 392. The processor 382 may be implemented as one or more CPU chips.

It is understood that by programming and/or loading executable instructions onto the computer system 380, at least one of the CPU 382, the RAM 388, and the ROM 386 are changed, transforming the computer system 380 in part into a particular machine or apparatus having the novel functionality taught by the present disclosure. It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

Additionally, after the system 380 is turned on or booted, the CPU 382 may execute a computer program or application (e.g., the vibration control application 21). For example, the CPU 382 may execute software or firmware stored in the ROM 386 or stored in the RAM 388. In some cases, on boot and/or when the application is initiated, the CPU 382 may copy the application or portions of the application from the secondary storage 384 to the RAM 388 or to memory space within the CPU 382 itself, and the CPU 382 may then execute instructions that the application is comprised of. In some cases, the CPU 382 may copy the application or portions of the application from memory accessed via the network connectivity devices 392 or via the I/O devices 390 to the RAM 388 or to memory space within the CPU 382, and the CPU 382 may then execute instructions that the application is comprised of. During execution, an application may load instructions into the CPU 382, for example load some of the instructions of the application into a cache of the CPU 382. In some contexts, an application that is executed may be said to configure the CPU 382 to do something, e.g., to configure the CPU 382 to perform the function or functions promoted by the subject application. When the CPU 382 is configured in this way by the application, the CPU 382 becomes a specific purpose computer or a specific purpose machine.

The secondary storage 384 is typically comprised of one or more disk drives or tape drives and is used for non-volatile storage of data and as an over-flow data storage device if RAM 388 is not large enough to hold all working data. Secondary storage 384 may be used to store programs which are loaded into RAM 388 when such programs are selected for execution. The ROM 386 is used to store instructions and perhaps data which are read during program execution. ROM 386 is a non-volatile memory device which typically has a small memory capacity relative to the larger memory capacity of secondary storage 384. The RAM 388 is used to store volatile data and perhaps to store instructions. Access to both ROM 386 and RAM 388 is typically faster than to secondary storage 384. The secondary storage 384, the RAM 388, and/or the ROM 386 may be referred to in some contexts as computer readable storage media and/or non-transitory computer readable media.

I/O devices 390 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 392 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards, and/or other well-known network devices. The network connectivity devices 392 may provide wired communication links and/or wireless communication links (e.g., a first network connectivity device 392 may provide a wired communication link and a second network connectivity device 392 may provide a wireless communication link). Wired communication links may be provided in accordance with Ethernet (IEEE 802.3), Internet protocol (IP), time division multiplex (TDM), data over cable system interface specification (DOCSIS), wave division multiplexing (WDM), and/or the like. In an embodiment, the radio transceiver cards may provide wireless communication links using protocols such as code division multiple access (CDMA), global system for mobile communications (GSM), long-term evolution (LTE), WiFi (IEEE 802.11), Bluetooth, Zigbee, narrowband Internet of things (NB IoT), near field communications (NFC), radio frequency identity (RFID). The radio transceiver cards may promote radio communications using 5G, 5G New Radio, or 5G LTE radio communication protocols. These network connectivity devices 392 may enable the processor 382 to communicate with the Internet or one or more intranets. With such a network connection, it is contemplated that the processor 382 might receive information from the network, or might output information to the network in the course of performing the above-described method steps. Such information, which is often represented as a sequence of instructions to be executed using processor 382, may be received from and outputted to the network, for example, in the form of a computer data signal embodied in a carrier wave.

Such information, which may include data or instructions to be executed using processor 382 for example, may be received from and outputted to the network, for example, in the form of a computer data baseband signal or signal embodied in a carrier wave. The baseband signal or signal embedded in the carrier wave, or other types of signals currently used or hereafter developed, may be generated according to several methods well-known to one skilled in the art. The baseband signal and/or signal embedded in the carrier wave may be referred to in some contexts as a transitory signal.

The processor 382 executes instructions, codes, computer programs, scripts which it accesses from hard disk, floppy disk, optical disk (these various disk based systems may all be considered secondary storage 384), flash drive, ROM 386, RAM 388, or the network connectivity devices 392. While only one processor 382 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 384, for example, hard drives, floppy disks, optical disks, and/or other device, the ROM 386, and/or the RAM 388 may be referred to in some contexts as non-transitory instructions and/or non-transitory information.

In an embodiment, the computer system 380 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 380 to provide the functionality of a number of servers that is not directly bound to the number of computers in the computer system 380. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 380, at least portions of the contents of the computer program product to the secondary storage 384, to the ROM 386, to the RAM 388, and/or to other non-volatile memory and volatile memory of the computer system 380. The processor 382 may process the executable instructions and/or data structures in part by directly accessing the computer program product, for example by reading from a CD-ROM disk inserted into a disk drive peripheral of the computer system 380. Alternatively, the processor 382 may process the executable instructions and/or data structures by remotely accessing the computer program product, for example by downloading the executable instructions and/or data structures from a remote server through the network connectivity devices 392. The computer program product may comprise instructions that promote the loading and/or copying of data, data structures, files, and/or executable instructions to the secondary storage 384, to the ROM 386, to the RAM 388, and/or to other non-volatile memory and volatile memory of the computer system 380.

In some contexts, the secondary storage 384, the ROM 386, and the RAM 388 may be referred to as a non-transitory computer readable medium or a computer readable storage media. A dynamic RAM embodiment of the RAM 388, likewise, may be referred to as a non-transitory computer readable medium in that while the dynamic RAM receives electrical power and is operated in accordance with its design, for example during a period of time during which the computer system 380 is turned on and operational, the dynamic RAM stores information that is written to it. Similarly, the processor 382 may comprise an internal RAM, an internal ROM, a cache memory, and/or other internal non-transitory storage blocks, sections, or components that may be referred to in some contexts as non-transitory computer readable media or computer readable storage media.

Figure 7A:
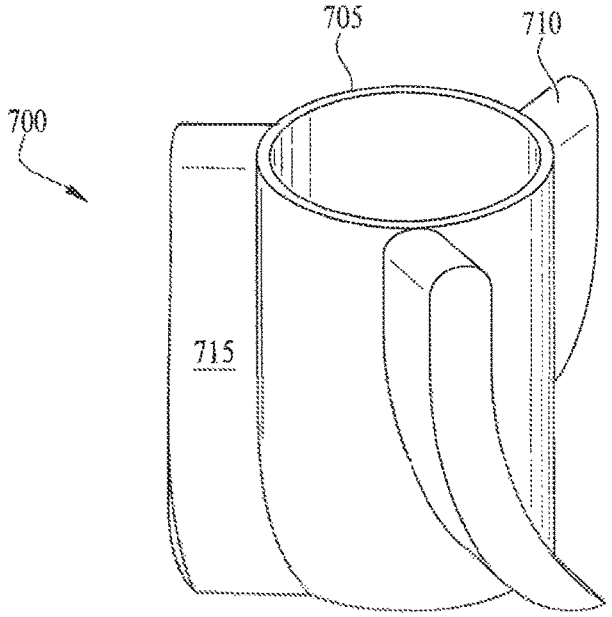
FIG. 7A is a perspective view of an exemplary spider bearing of an illustrative embodiment.
Figure 7B:
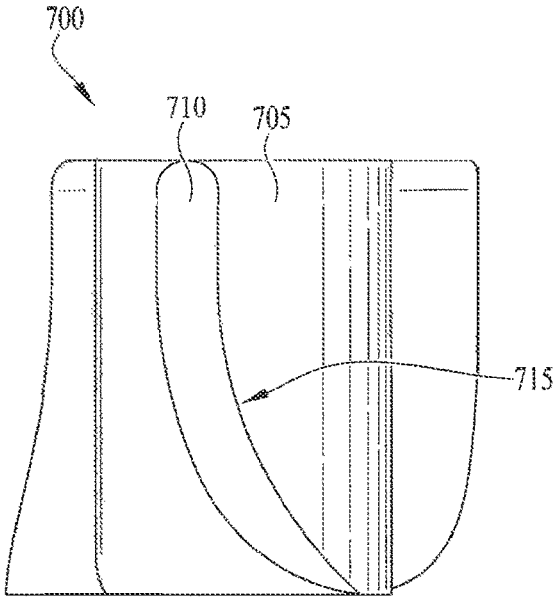
FIG. 7B is a side elevation view of an exemplary spider bearing of an illustrative embodiment.
Figure 7C:
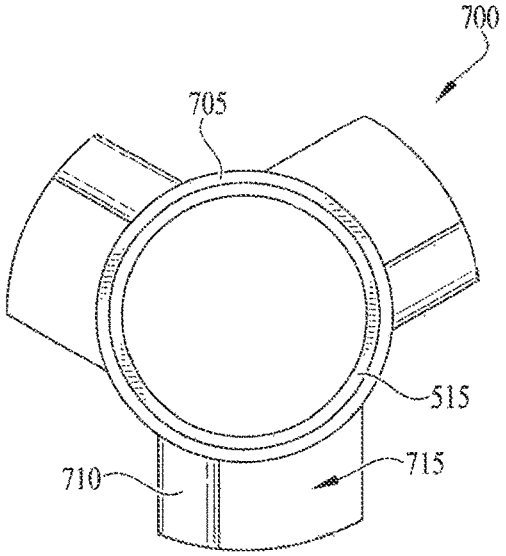
FIG. 7C is a top plan view of an exemplary spider bearing of an illustrative embodiment.

Returning to FIGS. 3B and 5, axial tube 505 may extend downstream from skirt 315 and may enclose shaft 215. One or more spacer sleeves 515 may be stacked around shaft 215 and separate axial tube 505 from shaft 215. Several spacer sleeves 515 may be stacked around shaft 215 and may provide radial support to shaft 215. Spider bearing 700 of illustrative embodiments may be included inside jacket 310 downstream of passageway exit 400 and/or skirt 315. An exemplary spider bearing 700 is shown in FIGS. 7A-7C. Spider bearing 700 may include bearing hub 705, which hub 705 may fit around one or more spacer sleeves 515 above axial tube 505. In certain embodiments, bearing hub 705 may be integral to axial tube 505 or may be stacked coaxially above axial tube 505 in other embodiments. In some embodiments, bushing 330 may be included between spacer sleeve 515 and spider bearing hub 705, as shown in FIGS. 3B and 7C. In one example, bushing 330 may be pressed and held static between spacer sleeve 515 and bearing hub 705. Spacer sleeve 515 may be coupled to shaft 215 so as to rotate with shaft 215, which may provide radial support and wear protection.

During operation, higher density, gas poor fluid 305 exiting second helical passageway 620 may be directed downstream through flow chute 625. Referring to FIGS. 6B and 6D, flow chute 625 may extend upward above skirt 315. Chute 625 may be shaped like an inverted funnel, sloping inward and/or narrowing as chute 625 extends downstream. Chute 625 may define a space for fluid to flow around axial tube 505. Flow chute 625 may receive higher density, gas poor fluid 305 exiting second helical passageway 620 and direct the fluid inward toward axial tube 505. Higher density, gas poor fluid 305 may proceed downstream toward spider bearing 700 through flow chute 625, for example shown in FIG. 6D.

Spider bearing 700 may receive the rotating higher density, gas poor fluid 305 from second helical passageway 620 and remove rotational momentum from the higher density, gas poor fluid. Higher density, gas poor fluid may be redirected with an axial component that prevents and/or reduces pre-rotation of gas poor fluid 305 as the fluid enters pump 120. Referring to FIGS. 7A-7C, spider bearing 700 may include a plurality of spider vanes 710 extending radially from bearing hub 705 toward jacket 310. In some embodiments, spider vanes 710 may contact the inside diameter of jacket 310 in order to maintain radial strength and/or provide radial support to shaft 215. Three spider vanes 710 are shown FIGS. 7A-7C, however, two, five or six spider vanes 710 may be employed in other embodiments. Each spider bearing vane 710 may be crescent-shaped or shaped like the bottom half of a horizontally-cut "C". The top portion of vanes 710 may extend vertically or substantially vertically along hub 705's outer diameter. The lower portion of vanes 710 may curve towards horizontal to form a ramp that curves from near-horizontal to vertical as vane 710 extends from bottom to top.

Spider bearing 700 vanes 710 may be curved to with a concave surface that receives oncoming higher density, gas poor fluid 305, which fluid stream 305's helical trajectory may include a rotational component directed counterclockwise, for example following counterclockwise rotation direction 615 in FIG. 6B. As a result, higher density, gas poor fluid 305 flowing toward spider bearing 700 may contact curved face 715 of bearing vane 710. Higher density, gas poor fluid stream 305 may be coerced upwards, following the increasingly straightened shape of vane 710. In this way, spider bearing 700 may convert rotational momentum into axial momentum thus reducing and/or preventing pre-rotation of fluid entering pump 120 and increasing the efficiency and performance of pump 120. Further, spider bearing 700 may provide radial strength during operation, thus preventing operation-limiting damage to ESP assembly 100.

Illustrative embodiments may reduce turbulence in fluid flowing through the crossover of a gas separator by improving the geometry of the crossover's passageways. Illustrative embodiments may include a plurality of channels defining first helical passageways inside the channels for lower density, gas rich fluid and second helical passageways around the outside of the channels for higher density, gas poor fluid. The first and second helical passageways may guide the corresponding fluid streams into and out of the passageways with a tangential component that provides gentle entrance and exit angles for the fluid, which may reduce turbulence, gas reentrapment, erosion and/or abrasive wear. Illustrative embodiments may guide lower density, gas rich fluid through the first helical passageways toward the casing annulus for ventilation with improved momentum and a reduced likelihood of gas reentrapment and the resulting gas lock. Illustrative embodiments may deliver higher density, gas poor fluid through the second helical passageways to a centrifugal pump with reduced pre-rotation, which improves the pump's efficiency and overall performance. Illustrative embodiments may reduce scale blocking, erosion, and abrasive damage resulting from higher density, gas poor fluid carrying sand into the gas separator. Illustrative embodiments may include a spider bearing with modified vanes that remove rotational momentum from the higher density, gas poor fluid, which may reduce pre-rotation in the centrifugal pump. Illustrative embodiments may enhance the efficiency of the crossover and improve the overall performance of the gas separator and centrifugal pump.

Further modifications and alternative embodiments of various aspects may be apparent to those skilled in the art in view of this description. It is to be understood that the embodiments illustrated and described herein are to be taken as the presently preferred embodiments. Elements and materials may be substituted for those illustrated and described herein, parts and processes may be reversed, and certain features may be utilized independently, all as would be apparent to one skilled in the art after having the benefit of this disclosure. Changes may be made in the elements described herein without departing from the scope and range of equivalents as described in the following claims. In addition, it is to be understood that features described herein independently may, in certain embodiments, be combined.

One or more embodiments of the disclosure enable a crossover apparatus, method and system for an electric submersible pump gas separator.

A crossover apparatus, method and system for an electric submersible pump gas separator is described. An illustrative embodiment of a crossover of an electric submersible pump (ESP) gas separator includes a teardrop shaped channel extending helically between and through a crossover skirt at an entrance to the channel, the crossover skirt inwards of a crossover jacket, the crossover jacket at an exit of the channel, the exit of the channel above the entrance to the channel, and the teardrop shape of the channel having a rounded side opposite a pointed side and a top channel surface extending therebetween, wherein the top channel surface extends between ten degrees and forty degrees upward from the pointed side, and the channel defining a first helical passageway inside the channel for lower density, gas rich fluid flowing inside the passageway, wherein the first helical passageway tangentially intersects the crossover jacket, and a second helical passageway around the channel for higher density, gas poor fluid flowing outside of the passageways, and a spider bearing fluidly coupled to the higher density, gas poor fluid downstream of the second helical passageway, the spider bearing including a plurality of crescent-shaped spider vanes extending radially outward from a spider bearing hub, the crescent shaped spider vanes having a concave surface that receives incoming higher density, gas poor fluid. In some embodiments, the crossover jacket is secured inside a gas separator housing downstream of one of a rotary or vortex generator. In certain embodiments, the channel exit is aligned with a housing port through the gas separator housing such that the channel exit is fluidly coupled to a casing annulus. In some embodiments, the channel entrance is positioned on a concave top portion of the crossover skirt. In certain embodiments, the position of the channel entrance on the concave top portion of the crossover skirt curves the channel entrance to tangentially align with the curvature of the lower density, gas rich fluid entering the channel entrance. In some embodiments, each channel entrance is 10-70% larger than conventional entrance ports in comparable conventional gas separator designs. In certain embodiments, an upper surface of a top wall of the channel extends ten to forty degrees from horizontal and guides higher density, gas poor fluid at same trajectory. In some embodiments, each channel curves as the channel extends upward from the crossover skirt to the crossover jacket. In certain embodiments, the channel tangentially intersects the jacket. In some embodiments, the tangential intersection guides fluid out the crossover exit tangentially to an inner wall of the crossover jacket. In certain embodiments, the spider bearing imparts axial momentum into the higher density, gas poor fluid exiting flowing around the passageways. In some embodiments, the spider bearing provides radial support to a shaft extending centrally through the crossover. In certain embodiments, the higher density, gas rich fluid is delivered to a centrifugal pump with lower GVF and reduced pre-rotation.

An illustrative embodiment of a crossover of an electric submersible pump (ESP) gas separator includes a first helical pathway that guides gas poor, higher density fluid at an angle of 10 to 40 degrees from a horizontal plane as the gas poor, higher density fluid travels through the crossover, the first helical pathway fluidly coupled to a spider bearing including crescent shaped vanes that remove rotational momentum from the gas poor, higher density fluid as the gas poor, higher density fluid exits the crossover, and a second helical pathway that guides gas rich, lower density fluid tangentially through exit ports of the crossover that vent to a casing annulus, and the first helical pathway and the second helical pathway defined by a channel having teardrop shaped openings in a crossover jacket that define the exit ports and teardrop shaped openings in the crossover skirt that define an entrance to the channel, where the first helical pathway is around the channel and the second helical pathway is through an inside of the channel. In some embodiments, the teardrop shaped openings in the crossover skirt are positioned on a concave top portion of the skirt. In certain embodiments, the curved orientation of the tear drop shaped openings extending around the concave top portion of the skirt provides the lower density, gas rich fluid a tangentially oriented entrance to the gas poor fluid helical passageway. In some embodiments, each teardrop shaped opening on the crossover skirt is 10-70% larger in surface area than conventional crossover skirt openings. In certain embodiments, a top surface of the channel extends upward at ten to forty degrees from horizontal and guides the higher density, gas poor fluid upward at same trajectory. In some embodiments, the channel tangentially intersects the jacket. In certain embodiments, the spider bearing imparts axial momentum to the higher density, gas poor fluid traveling around the passageways and continuing past the spider bearing. In some embodiments, the spider bearing provides radial support to a drive shaft extending through the crossover. In certain embodiments, the crossover of an ESP gas separator includes a plurality of the channels.

An illustrative embodiments of a method of separating higher density, gas poor fluid from lower density, gas rich fluid in a gas separator that operates to separate multi-phase fluid by rotational inertia includes maintaining a helical trajectory of lower density, gas rich fluid by sending the lower density, gas rich fluid through an inside of a helically extending, teardrop-shaped channel that vents vent to a casing annulus, preserving a helical trajectory of higher density, gas poor fluid by sending the higher density, gas poor fluid around the helical channel, and removing rotational momentum from the higher density, gas poor fluid after the higher density, gas poor fluid passes around the helical channel, by guiding the higher density, gas poor fluid through a spider bearing having crescent shaped vanes and a concave surface that curves in a direction opposite the rotational direction of the higher density, gas poor fluid. In certain embodiments, the method further includes delivering the higher density, gas poor fluid to a pump intake with lower rotational momentum and GVF than fluid entering the gas separator.

In further embodiments, features from specific embodiments may be combined with features from other embodiments. For example, features from one embodiment may be combined with features from any of the other embodiments. In further embodiments, additional features may be added to the specific embodiments described herein.

Additional Disclosure Part I

The following are non-limiting, specific embodiments in accordance with the present disclosure:

A first embodiment, which is a crossover of an electric submersible pump (ESP) gas separator comprising a teardrop shaped channel extending helically between and through a crossover skirt at an entrance to the channel, the crossover skirt inwards of a crossover jacket, the crossover jacket at an exit of the channel, the exit of the channel above the entrance to the channel, and the teardrop shape of the channel having a rounded side opposite a pointed side and a top channel surface extending therebetween, wherein the top channel surface extends between ten degrees and forty degrees upward from the pointed side, and the channel defining a first helical passageway inside the channel for lower density, gas rich fluid flowing inside the passageway, wherein the first helical passageway tangentially intersects the crossover jacket, and a second helical passageway around the channel for higher density, gas poor fluid flowing outside of the passageways, and a spider bearing fluidly coupled to the higher density, gas poor fluid downstream of the second helical passageway, the spider bearing comprising a plurality of crescent-shaped spider vanes extending radially outward from a spider bearing hub, the crescent shaped spider vanes having a concave surface that receives incoming higher density, gas poor fluid.

A second embodiment, which is the crossover of an ESP gas separator of the first embodiment, wherein the crossover jacket is secured inside a gas separator housing downstream of one of a rotary or vortex generator.

A third embodiment, which is the crossover of an ESP gas separator of any of the first and the second embodiments, wherein the channel exit is aligned with a housing port through the gas separator housing such that the channel exit is fluidly coupled to a casing annulus.

A fourth embodiment, which is the crossover of an ESP gas separator of any of the first through the third embodiments, wherein the channel entrance is positioned on a concave top portion of the crossover skirt.

A fifth embodiment, which is the crossover of an ESP gas separator of the fourth embodiment, wherein the position of the channel entrance on the concave top portion of the crossover skirt curves the channel entrance to tangentially align with the curvature of the lower density, gas rich fluid entering the channel entrance.

A sixth embodiment, which is the crossover of an ESP gas separator of any of the first through the fifth embodiments, wherein each channel entrance is 10-70% larger than conventional entrance ports in comparable conventional gas separator designs.

A seventh embodiment, which is the crossover of an ESP gas separator of any of the first through the sixth embodiments, wherein an upper surface of a top wall of the channel extends ten to forty degrees from horizontal and guides higher density, gas poor fluid at same trajectory.

An eighth embodiment, which is the crossover of an ESP gas separator of any of the first through the seventh embodiments, wherein each channel curves as the channel extends upward from the crossover skirt to the crossover jacket.

A ninth embodiment, which is the crossover of an ESP gas separator of any of the first through the eighth embodiments, wherein the channel tangentially intersects the jacket.

A tenth embodiment, which is the crossover of an ESP gas separator of the ninth embodiment, wherein the tangential intersection guides fluid out the crossover exit tangentially to an inner wall of the crossover jacket.

An eleventh embodiment, which is the crossover of an ESP gas separator of any of the first through the tenth embodiments, wherein the spider bearing imparts axial momentum into the higher density, gas poor fluid exiting flowing around the passageways.

A twelfth embodiment, which is the crossover of an ESP gas separator of any of the first through the eleventh embodiments, wherein the spider bearing provides radial support to a shaft extending centrally through the crossover.

A thirteenth embodiment, which is the crossover of an ESP gas separator of any of the first through the twelfth embodiments, wherein the higher density, gas rich fluid is delivered to a centrifugal pump with lower GVF and reduced pre-rotation.

A fourteenth embodiment, which is the crossover of an ESP gas separator of any of the first through the thirteenth embodiments, wherein the crossover jacket is rotatable around the crossover skirt.

A fifteenth embodiment, which is a crossover of an electric submersible pump (ESP) gas separator comprising a first helical pathway that guides gas poor, higher density fluid at an angle of 10 to 40 degrees from a horizontal plane as the gas poor, higher density fluid travels through the crossover, the first helical pathway fluidly coupled to a spider bearing comprising crescent shaped vanes that remove rotational momentum from the gas poor, higher density fluid as the gas poor, higher density fluid exits the crossover, and a second helical pathway that guides gas rich, lower density fluid tangentially through exit ports of the crossover that vent to a casing annulus, and the first helical pathway and the second helical pathway defined by a channel having teardrop shaped openings in a crossover jacket that define the exit ports and teardrop shaped openings in the crossover skirt that define an entrance to the channel, where the first helical pathway is around the channel and the second helical pathway is through an inside of the channel.

A sixteenth embodiment, which is the crossover of an ESP gas separator of the fifteenth embodiment, wherein the teardrop shaped openings in the crossover skirt are positioned on a concave top portion of the skirt.

A seventeenth embodiment, which is the crossover of an ESP gas separator of the sixteenth embodiment, wherein the curved orientation of the tear drop shaped openings extending around the concave top portion of the skirt provides the lower density, gas rich fluid a tangentially oriented entrance to the gas poor fluid helical passageway.

An eighteenth embodiment, which is the crossover of an ESP gas separator of any of the fifteenth through the seventeenth embodiments, wherein each teardrop shaped opening on the crossover skirt is 10-70% larger in surface area than conventional crossover skirt openings.

A nineteenth embodiment, which is the crossover of an ESP gas separator of any of the fifteenth through the eighteenth embodiments, wherein a top surface of the channel extends upward at ten to forty degrees from horizontal and guides the higher density, gas poor fluid upward at same trajectory.

A twentieth embodiment, which is the crossover of an ESP gas separator of any of the fifteenth through the nineteenth embodiments, wherein the channel tangentially intersects the jacket.

A twenty-first embodiment, which is the crossover of an ESP gas separator of any of the fifteenth through the twentieth embodiment, wherein the spider bearing imparts axial momentum to the higher density, gas poor fluid traveling around the passageways and continuing past the spider bearing.

A twenty-second embodiment, which is the crossover of an ESP gas separator of any of the fifteenth through the twenty-first embodiments, wherein the spider bearing provides radial support to a drive shaft extending through the crossover.

A twenty-third embodiment, which is the crossover of an ESP gas separator of any of the fifteenth through the twenty-second embodiments, comprising a plurality of the channels.

A twenty-fourth embodiment, which is a method of separating higher density, gas poor fluid from lower density, gas rich fluid in a gas separator that operates to separate multiphase fluid by rotational inertia comprising maintaining a helical trajectory of lower density, gas rich fluid by sending the lower density, gas rich fluid through an inside of a helically extending, teardrop-shaped channel that vents vent to a casing annulus, preserving a helical trajectory of higher density, gas poor fluid by sending the higher density, gas poor fluid around the helical channel, and removing rotational momentum from the higher density, gas poor fluid after the higher density, gas poor fluid passes around the helical channel, by guiding the higher density, gas poor fluid through a spider bearing having crescent shaped vanes and a concave surface that curves in a direction opposite the rotational direction of the higher density, gas poor fluid.

A twenty-fifth embodiment, which is the method of the twenty-fourth embodiment, further comprising delivering the higher density, gas poor fluid to a pump intake with lower rotational momentum and GVF than fluid entering the gas separator.

Additional Disclosure Part II

The following are non-limiting, specific embodiments in accordance with the present disclosure:

A first embodiment, which is a crossover of an electric submersible pump (ESP) gas separator, comprising a skirt defining a first plurality of exits, and a jacket defining a second plurality of exits, wherein the jacket is disposed around an outside of the skirt, concentric with the skirt, and is rotatably coupled to the skirt.

A second embodiment, which is the crossover of the first embodiment, wherein the first and second plurality of exits are circular in shape, oval in shape, rectangular in shape, trapezoidal in shape, or teardrop in shape.

A third embodiment, which is the crossover of the first or the second embodiment, wherein the number of the first plurality of exits is the same as the number of the second plurality of exits.

A fourth embodiment, which is the crossover of any of the first through the third embodiments, wherein the number of the first plurality of exits is different from the number of the second plurality of exits.

A fifth embodiment, which is the crossover of any of the first through the fourth embodiments, wherein the jacket defines a plurality of threaded through-holes.

A sixth embodiment, which is the crossover of any of the first through the fifth embodiments, wherein an inside diameter of the jacket is less than 0.1 inch greater than an outside diameter of the skirt.

A seventh embodiment, which is the crossover of any of the first through the sixth embodiment, wherein an outside surface of the skirt defines a plurality of concave indentations.

An eighth embodiment, which is the crossover of the seventh embodiment, wherein the concave indentations are located at a 10 degree rotational offset, a 20 degree rotational offset, and a 30 degree offset from a full-open exit rotational position.

A ninth embodiment, which is the crossover of the eighth embodiment, where additional concave indentations are located a 40 degree offset from the full-open exit rotational position.

A tenth embodiment, which is the crossover of the ninth embodiment, where additional concave indentations are located at a 5 degree rotational offset, a 15 degree rotational offset, a 25 degree rotational offset, and a 35 degree rotational offset from the full-open exit rotational position.

An eleventh embodiment, which is the crossover of any of the first through the tenth embodiments, wherein the second plurality of exits is three exits.

A twelfth embodiment, which is the crossover of any of the first through the eleventh embodiments, wherein the jacket is formed of stainless steel, carbide metal, or titanium metal.

A thirteenth embodiment, which is a method of producing liquid fluid from a wellbore, comprising adjusting an exit opening size of a gas separator of an electric submersible pump (ESP) assembly at the wellbore, operating the ESP assembly in the wellbore, expelling fluid from an interior of the gas separator out the exit while operating the ESP assembly in the wellbore, and pumping liquid fluid to the surface at the wellbore.

A fourteenth embodiment, which is the method of the thirteenth embodiment, wherein adjusting the exit opening comprises rotating a portion of the gas separator relative to a centerline of the gas separator.

A fifteenth embodiment, which is a method of producing hydrocarbons by an electric submersible pump (ESP) assembly from a wellbore, comprising rotationally displacing a jacket with reference to a gas separator of the ESP assembly about a central axis of the gas separator to offset a plurality of exits defined by the jacket with reference to a plurality of exits defined by a skirt of the gas separator, securing the jacket relative to the skirt of the gas separator, operating the ESP assembly in the wellbore, expelling a quantity of fluid out of the exits defined by the jacket, wherein the quantity of fluid expelled depends in part on the offset between the exits defined by the jacket and the exits defined by the skirt of the gas separator, and lifting hydrocarbons by the ESP assembly to the surface at the wellbore.

A sixteenth embodiment, which is the method of the fifteenth embodiment, wherein an alignment of the exits defined by the jacket with reference to the plurality of exits defined by the skirt after rotationally displaying the jacket provides a reduced exit area that is about 90% of a maximum exit area of the jacket exits.

A seventeenth embodiment, which is the method of any of the fifteenth and sixteenth embodiments, wherein an alignment of the exits defined by the jacket with reference to the plurality of exits defined by the skirt after rotationally displaying the jacket provides a reduced exit area that is about 66% of a maximum exit area of the jacket exits.

An eighteenth embodiment, which is the method of any of the fifteenth through the seventeenth embodiments, wherein an alignment of the exits defined by the jacket with reference to the plurality of exits defined by the skirt after rotationally displacing the jacket provides a reduced exit area that is about 20% of a maximum exit area of the jacket exits.

A nineteenth embodiment, which is the method of any of the fifteenth through the eighteenth embodiments, wherein securing the jacket relative to the skirt of the gas separator comprises tightening a plurality of set screws installed into corresponding threaded through-holes in the jacket.

A twentieth embodiment, which is the method of the nineteenth embodiment, wherein securing the jacket relative to the skirt of the gas separator comprises aligning the set screws with corresponding concave indentation defined by a surface of the skirt of the gas separator.

A twenty-first embodiment, which is a crossover of an electric submersible pump (ESP) gas separator, comprising a skirt defining a plurality of exits, passageways, and entrances, each exit associated with one of the passageways and one of the entrances, wherein each entrance is proximate to an inner chamber of the gas separator, and a jacket circumferentially surrounding the skirt and defining a plurality of exits, wherein the rotational position of the jacket relative to the skirt is adjustable.

A twenty-second embodiment, which is the crossover of the first or the twenty-first embodiment, wherein a position of the plurality of exits of the jacket relative to a position of the plurality of exist of the skirt define an exit area of the crossover, and wherein adjustment of the rotational position of the jacket relative to the skirt is configured to increase or decrease the exit area of the crossover.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k* (Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A crossover of an electric submersible pump (ESP) gas separator, comprising:

a skirt defining a first plurality of exits; and a jacket defining a second plurality of exits, wherein the jacket is disposed around an outside of the skirt, is concentric with the skirt, is rotatably coupled to the skirt, and is configured to adjust an exit area defined by an alignment of the first plurality of exits and the second plurality of exits by rotating the jacket around the skirt to establish the exit area and by rotationally securing the jacket to the skirt to maintain the established exit area.

2. The crossover of claim 1, wherein the first and second plurality of exits are circular in shape, oval in shape, rectangular in shape, trapezoidal in shape, or teardrop in shape.

3. The crossover of claim 1, wherein the number of the first plurality of exits is the same as the number of the second plurality of exits.

4. The crossover of claim 1, wherein the number of the first plurality of exits is different from the number of the second plurality of exits.

5. The crossover of claim 1, wherein the jacket defines a plurality of threaded through-holes.

6. The crossover of claim 1, wherein an inside diameter of the jacket is less than 0.1 inch greater than an outside diameter of the skirt.

7. The crossover of claim 1, wherein an outside surface of the skirt defines a plurality of concave indentations.

8. The crossover of claim 7, wherein the concave indentations are located at a 10 degree rotational offset, a 20 degree rotational offset, and a 30 degree offset from a full-open exit rotational position.

9. The crossover of claim 8, where additional concave indentations are located a 40 degree offset from the full-open exit rotational position.

10. The crossover of claim 9, where more concave indentations are located at a 5 degree rotational offset, a 15 degree rotational offset, a 25 degree rotational offset, and a 35 degree rotational offset from the full-open exit rotational position.

11. The crossover of claim 1, wherein a position of the plurality of exits of the jacket relative to a position of the plurality of exist of the skirt define an exit area of the crossover, and wherein adjustment of the rotational position of the jacket relative to the skirt is configured to increase or decrease the exit area of the crossover.

12. A method of producing liquid fluid from a wellbore, comprising:

adjusting an exit opening size of a gas separator of an electric submersible pump (ESP) assembly at the wellbore, wherein adjusting the exit opening comprises rotating a portion of the gas separator relative to a centerline of the gas separator;

operating the ESP assembly in the wellbore;

expelling fluid from an interior of the gas separator out the exit while operating the ESP assembly in the wellbore; and pumping liquid fluid to the surface at the wellbore.

13. A method of producing hydrocarbons by an electric submersible pump (ESP) assembly from a wellbore, comprising:

rotationally displacing a jacket with reference to a gas separator of the ESP assembly about a central axis of the gas separator to offset a plurality of exits defined by the jacket with reference to a plurality of exits defined by a skirt of the gas separator;

securing the jacket relative to the skirt of the gas separator;

operating the ESP assembly in the wellbore;

expelling a quantity of fluid out of the exits defined by the jacket, wherein the quantity of fluid expelled depends in part on the offset between the exits defined by the jacket and the exits defined by the skirt of the gas separator; and lifting hydrocarbons by the ESP assembly to the surface at the wellbore, wherein an alignment of the exits defined by the jacket with reference to the plurality of exits defined by the skirt after rotationally displacing the jacket provides a reduced exit area that is about 90% of a maximum exit area of the jacket exits.

14. A method of producing hydrocarbons by an electric submersible pump (ESP) assembly from a wellbore, comprising:

rotationally displacing a jacket with reference to a gas separator of the ESP assembly about a central axis of the gas separator to offset a plurality of exits defined by the jacket with reference to a plurality of exits defined by a skirt of the gas separator;

securing the jacket relative to the skirt of the gas separator;

operating the ESP assembly in the wellbore;

expelling a quantity of fluid out of the exits defined by the jacket, wherein the quantity of fluid expelled depends in part on the offset between the exits defined by the jacket and the exits defined by the skirt of the gas separator; and lifting hydrocarbons by the ESP assembly to the surface at the wellbore, wherein an alignment of the exits defined by the jacket with reference to the plurality of exits defined by the skirt after rotationally displacing the jacket provides a reduced exit area that is about 66% of a maximum exit area of the jacket exits.

15. A method of producing hydrocarbons by an electric submersible pump (ESP) assembly from a wellbore, comprising:

rotationally displacing a jacket with reference to a gas separator of the ESP assembly about a central axis of the gas separator to offset a plurality of exits defined by the jacket with reference to a plurality of exits defined by a skirt of the gas separator;

securing the jacket relative to the skirt of the gas separator;

operating the ESP assembly in the wellbore;

expelling a quantity of fluid out of the exits defined by the jacket, wherein the quantity of fluid expelled depends in part on the offset between the exits defined by the jacket and the exits defined by the skirt of the gas separator; and lifting hydrocarbons by the ESP assembly to the surface at the wellbore, wherein an alignment of the exits defined by the jacket with reference to the plurality of exits defined by the skirt after rotationally displacing the jacket provides a reduced exit area that is about 20% of a maximum exit area of the jacket exits.

16. A method of producing hydrocarbons by an electric submersible pump (ESP) assembly from a wellbore, comprising:

rotationally displacing a jacket with reference to a gas separator of the ESP assembly about a central axis of the gas separator to offset a plurality of exits defined by the jacket with reference to a plurality of exits defined by a skirt of the gas separator;

securing the jacket relative to the skirt of the gas separator;

operating the ESP assembly in the wellbore;

expelling a quantity of fluid out of the exits defined by the jacket, wherein the quantity of fluid expelled depends in part on the offset between the exits defined by the jacket and the exits defined by the skirt of the gas separator; and lifting hydrocarbons by the ESP assembly to the surface at the wellbore, wherein securing the jacket relative to the skirt of the gas separator comprises tightening a plurality of set screws installed into corresponding threaded through-holes in the jacket.

17. The method of claim 16, wherein securing the jacket relative o the skirt of the gas separator comprises aligning the set screws with corresponding concave indentation defined by a surface of the skirt of the gas separator.

* * * * *